US007938197B2

(12) United States Patent
Boone et al.

(10) Patent No.: US 7,938,197 B2
(45) Date of Patent: May 10, 2011

(54) AUTOMATED MSE-BASED DRILLING APPARATUS AND METHODS

(75) Inventors: Scott Boone, Houston, TX (US); Brian Ellis, Spring, TX (US); Beat Kuttel, Spring, TX (US); Chris Papouras, Houston, TX (US); John Thomas Scarborough, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 371 days.

(21) Appl. No.: 11/952,511

(22) Filed: Dec. 7, 2007

(65) Prior Publication Data

US 2008/0156531 A1 Jul. 3, 2008

Related U.S. Application Data

(63) Continuation-in-part of application No. 11/859,378, filed on Sep. 21, 2007.

(60) Provisional application No. 60/869,047, filed on Dec. 7, 2006, provisional application No. 60/985,869, filed on Nov. 6, 2007.

(51) Int. Cl.
*E21B 47/12* (2006.01)

(52) U.S. Cl. ..... 175/27; 175/40

(58) Field of Classification Search ..... 175/24, 175/27, 40

See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgerwood, Jr. |
| 3,223,183 | A | 12/1965 | Varney |
| 3,265,359 | A | 8/1966 | Bowden |
| 3,407,886 | A | 10/1968 | Bennett |
| 3,550,697 | A | 12/1970 | Hobhouse |
| 4,492,276 | A | 1/1985 | Kamp |
| 4,535,972 | A | 8/1985 | Millheim et al. |
| 4,662,608 | A | 5/1987 | Ball |
| 4,854,397 | A | 8/1989 | Warren et al. |
| 4,958,125 | A | 9/1990 | Jardine et al. |
| 5,103,920 | A | 4/1992 | Patton |
| 5,205,163 | A | 4/1993 | Sananikone |
| 5,358,059 | A | 10/1994 | Ho |
| 5,390,748 | A | 2/1995 | Goldman |
| 5,467,832 | A | 11/1995 | Orban et al. |
| 5,474,142 | A | 12/1995 | Bowden |
| 5,551,286 | A | 9/1996 | Booer |
| 5,713,422 | A | 2/1998 | Dhindsa |

(Continued)

FOREIGN PATENT DOCUMENTS

EP 0774563 B1 7/2002

(Continued)

OTHER PUBLICATIONS

Petroleum Extension Service, "Controlled Directional Drilling," N. Janicek (ed.), Third Edition, pp. 18-33 and 44-45, 1984.

(Continued)

*Primary Examiner* — William P Neuder
(74) *Attorney, Agent, or Firm* — Haynes and Boone, LLP

(57) ABSTRACT

Methods and apparatus for MSE-based drilling operation and/or optimization, comprising detecting MSE parameters, utilizing the MSE parameters to determine MSE, and automatically adjusting drilling operational parameters as a function of the determined MSE.

12 Claims, 13 Drawing Sheets

U.S. PATENT DOCUMENTS

| | | | | |
|---|---|---|---|---|
| 5,730,234 | A | 3/1998 | Putot | |
| 5,738,178 | A | 4/1998 | Williams et al. | |
| 5,842,149 | A | 11/1998 | Harrell et al. | |
| 6,026,912 | A | 2/2000 | King et al. | |
| 6,029,951 | A | 2/2000 | Guggari | |
| 6,050,348 | A | 4/2000 | Richarson et al. | |
| 6,092,610 | A | 7/2000 | Kosmala et al. | |
| 6,152,246 | A | 11/2000 | King et al. | |
| 6,155,357 | A | 12/2000 | King et al. | |
| 6,192,998 | B1 | 2/2001 | Pinckard | |
| 6,233,498 | B1 | 5/2001 | King et al. | |
| 6,293,356 | B1 | 9/2001 | King et al. | |
| 6,382,331 | B1 | 5/2002 | Pinckard | |
| 6,405,808 | B1 | 6/2002 | Edwards et al. | |
| 6,757,613 | B2 | 6/2004 | Chapman et al. | |
| 6,802,378 | B2 | 10/2004 | Haci et al. | |
| 6,820,702 | B2 | 11/2004 | Niedermayr et al. | |
| 6,892,812 | B2 | 5/2005 | Niedermayr et al. | |
| 7,000,710 | B1 | 2/2006 | Umbach | |
| 7,032,689 | B2 | 4/2006 | Goldman et al. | |
| 7,044,239 | B2 | 5/2006 | Pinckard et al. | |
| 7,059,427 | B2 | 6/2006 | Power et al. | |
| 7,085,696 | B2 | 8/2006 | King | |
| 7,096,979 | B2 | 8/2006 | Haci et al. | |
| 7,243,735 | B2 * | 7/2007 | Koederitz et al. | 175/40 |
| 7,357,196 | B2 * | 4/2008 | Goldman et al. | 175/24 |
| 7,546,209 | B2 | 6/2009 | Williams | |
| 7,584,788 | B2 | 9/2009 | Baron et al. | |
| 7,665,533 | B2 | 2/2010 | Hopwood et al. | |
| 7,775,297 | B2 | 8/2010 | Hopwood et al. | |
| 2002/0104685 | A1 | 8/2002 | Pinckard et al. | |
| 2003/0024738 | A1 | 2/2003 | Schuh | |
| 2004/0028476 | A1 | 2/2004 | Payne et al. | |
| 2006/0185899 | A1 | 8/2006 | Alft et al. | |
| 2007/0203651 | A1 | 8/2007 | Blanz et al. | |
| 2007/0256861 | A1 | 11/2007 | Hulick | |
| 2009/0078462 | A1 | 3/2009 | Boone | |
| 2009/0090555 | A1 * | 4/2009 | Boone et al. | 175/45 |
| 2009/0159336 | A1 | 6/2009 | Boone | |
| 2009/0250264 | A1 * | 10/2009 | Dupriest | 175/40 |

FOREIGN PATENT DOCUMENTS

| | | |
|---|---|---|
| WO | WO 93/12318 | 6/1993 |
| WO | WO 2004/055325 | 7/2004 |
| WO | WO 2008/070829 | 12/2008 |
| WO | WO 2009/039448 | 3/2009 |
| WO | WO 2009/039453 | 3/2009 |

OTHER PUBLICATIONS

Goldman, "Artificial Intelligence Applications Enhance Directional Control," *Petroleum Engineer International,* pp. 15-22, Feb. 1993.
Bonner, et al., "Measurements at the Bit: A New Generation of MWD Tools," *Oilfield Review,* pp. 44-54, Apr./Jul. 1993.
Jackson, et al., "Portable Top Drive Cuts Horizontal Drilling Costs," *World Oil Magazine,* vol. 214 Issue 11, pp. 81-89, Nov. 1993.
Murch, "Application of Top Drive Drilling to Horizontal Wells," Society of Petroleum Engineers—SPE 37100, 1996.
Plaintiff's Original Complaint; Case 6:09-cv-00414; Doc. 1; Sep. 16, 2009.
Answer to Plaintiff's Complaint; Case 6:09-cv-00414-LED; Doc 25; Nov. 6, 2009.
Defendant Helmerich & Payne's Invalidity Contentions; Case 6:09-cv-00414-LED; Mar. 25, 2010.
Defendant Omron Oilfield and Marine, Inc's Patent Rule 3-3 Disclosures; Case 6:09-cv-00414-LED; Mar. 25, 2010.
Defendant Omron Oilfield and Marine, Inc's Patent Rule 3-4 Disclosures; Case 6:09-cv-00414-LED; Mar. 25, 2010.
Helmerich & Payne, Inc.'s First Amended Answer and Counterclaims to Plaintiff's Original Complaint; Case 6:09-cv-00414-LED; Doc 55; Mar. 25, 2010.
Maidla, Eric, et al. "Understanding Torque: The Key to Slide-Drilling Directional Wells" in IADC/SPE Drilling Conference, 2004.
The International Searching Authority, "Written Opinion of the International Searching Authority," PCT/US2007/86768, mailed Jun. 11, 2008.
U.S. Appl. No. 12/380,229, filed Feb. 20, 2009, Boone.
Gurari, E., "CIS 680: Data Structures: Chapter 19: Backtracking Algorithms;" http://www.cse.ohio-state.edu/%7Egurari/course/cis680/cis680Ch19.html (1999).
Leine, et al., "Stick-Slip Whirl Interaction in Drillstring Dynamics," *J. of Vibration and Acoustics,* 124: 209-220 (2002).
U.S. Appl. No. 11/668,388, filed Jul. 24, 2008, Pradeep, et al.
U.S. Appl. No. 11/747,110, filed Nov. 13, 2008, Boone.
U.S. Appl. No. 11/847,048, filed Mar. 5, 2009, Papouras, et al.
Brown, et al., "In-Time Data Delivery," *Oilfield Review,* 11(4): 34-55, http://www.slb.com/media/services/resources/oilfieldreview/ors99/win99/pages34_55.pdf (Winter 1999/2000).
Young, Jr., "Computerized Drilling Control," *Journal of Petroleum Technology,* 21(4): 483-96 (1969).
Brett, et al., "Field Experiences with Computer-Controlled Drilling," *Society of Petroleum Engineers 20107,* presented at *Permian Basin Oil and Gas Recovery Conference,* Midland, TX (Mar. 8-9, 1990).
"Wildcat ADS Automated Drilling System," Product Brochure, National Oilwell Varco, Inc. (2006).
"40223705-Series Wildcat Services Pneumatic Automated Drilling System," available at http://www.nov.com/Drilling/Control_and_Advisiory_Systems/Drawworks_Control_Auto_Drilling/Auto_Drillers.aspx (last visited Oct. 8, 2009).
Dupriest, Fred E., et al, "Maximizing Drill Rates with Real-Time Surveillance of Mechanical Specific Energy" at SPE/IADC Drilling Conference 92194, Amsterdam, The Netherlands, Feb. 23-25, 2005, pp. 1-10.
Dupriest, Fred E., "Comprehensive Drill-Rate Management Process to Maximize Rate of Penetration" at SPE Annual Technical Conference and Exhibition, San Antonio, Texas, Sep. 24-27, 2006, pp. 1-9.
Dupriest, Fred E. "Maximizing ROP With Real-Time Analysis of Digital Data and MSE" at the International Petroleum Technology Conference, Doha, Qatar, Nov. 21-23, 2005, pp. 1-8.
Hartley, Frank, et al. "New Drilling Process Increases Rate of Penetration, Footage Per Day", in Offshore, vol. 66, Issue 1, Jan. 2006, pp. 1-5.
Canrig's Answers to Omron Oilfield and Marine, Inc.'s First Set of Interrogatories, Civil Action No. 6:09-cv-00414, May 7, 2010.
Canrig Drilling Technology Ltd.'s Objections and Responses to Helmerick & Payne's First Set of Interrogatories, Civil Action No. 6:09-cv-00414, Aug. 23, 2010.
Defendant's Joint Preliminary Claim Construction and Extrinsic Evidence, Civil Action No. 6:09-cv-00414LED, Sep. 24, 2010.
Plaintiff Canrig's Local Patent Rule 4-2 Disclosures, Civil Action No. 6:09-cv-00414, Sep. 24, 2010.
Joint Claim Construction Statement, Civil Action No. 6:09-cv-00414LED, Oct. 25, 2010.
U.S. Appl. No. 12/855,035, filed Aug. 12, 2010, Boone.

* cited by examiner

AUTOMATED MSE-BASED DRILLING APPARATUS AND METHODS

CROSS-REFERENCE TO RELATED APPLICATIONS

The present disclosure claims the benefit of the earlier filing date of each of the following, the entirety of which are hereby incorporated by reference:

U.S. Provisional Patent Application No. 60/869,047, filed Dec. 7, 2006, entitled "MSE-Based Drilling Operation,"

U.S. Provisional Patent Application No. 60/985,869, filed Nov. 6, 2007, entitled "ΔT-Based Drilling Operation,"; and this application is a continuation-in-part of U.S. patent application Ser. No. 11/859,378, filed Sep. 21, 2007, entitled "Directional Drilling Control,".

BACKGROUND

Recent developments in drilling optimization use real time analysis of the energy consumption of the drilling system to optimize the rate of penetration (ROP). Such optimization can provide instantaneous ROP increases of 100-400% and increases in footage per day. Similar results can be achieved in soft and hard formations, low and high angle wells, and with all rig types.

However, it is difficult to objectively assess operators' drill rate performance. that is, bits are often evaluated based on their performance relative to offsets, but drill rates are often constrained by factors that the driller does not control, and in ways that cannot be documented in a bit record. Consequently, drill rates may vary greatly between two wells running identical bits. The manner in which a bit is run is often more important than which bit is run.

Drillers conduct a variety of tests to optimize performance. The most common is the "drill rate" test, which consists of simply experimenting with various weight on bit (WOB) and bit rotational speed (RPM) settings and observing the results. The parameters that result in the highest ROP are then used for subsequent operations. In some sense, all optimization schemes use a similar comparative process. That is, they seek to identify the parameters that yield the best results relative to other settings.

One of the earliest schemes was the "drilloff" test, in which the driller applied a high WOB and locked the brake to prevent the top of the string from advancing while continuing to circulate and rotate the string. As the bit drilled ahead, the string elongated and the WOB declined. ROP was calculated from the change in the rate of drill string elongation as the weight declined. The point at which the ROP stops responding linearly with increasing WOB is referred to as the "flounder" or "founder" point. This is taken to be the optimum WOB. This process has enhanced performance, but does not provide an objective assessment of the true potential drill rate.

DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
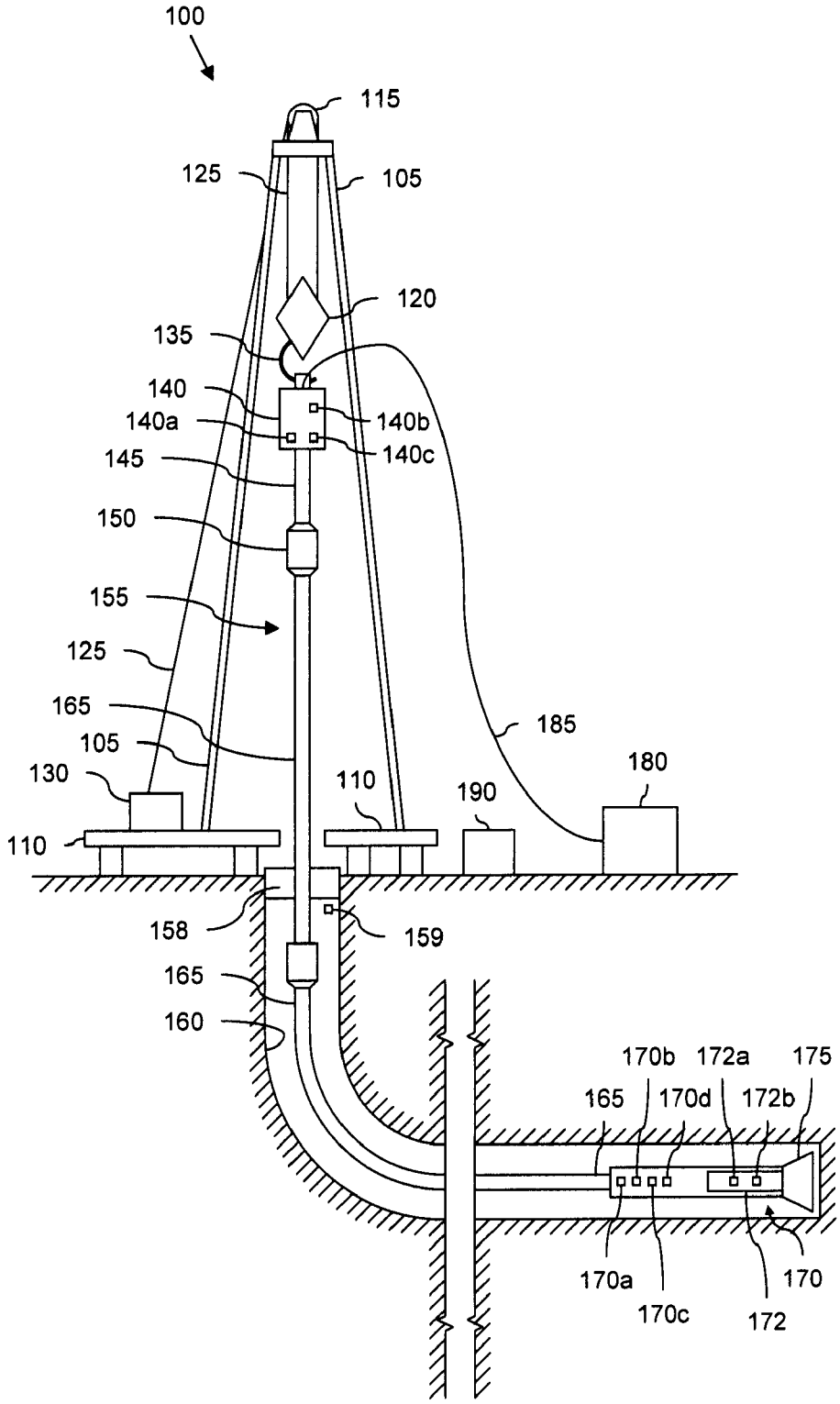
FIG. 1 is a schematic diagram of apparatus according to aspects of the present disclosure.

The present disclosure is also related to and incorporates by reference the entirety of U.S. Pat. No. 6,050,348 to Richarson, et al.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively comprise a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary embodiment, the controller 190 comprises one or more systems located in a control room proximate the apparatus 100, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission means which, for the sake of clarity, are not depicted in FIG. 1.

The controller 190 is also configured to receive electronic signals via wired or wireless transmission means (also not shown in FIG. 1) from a variety of sensors included in the apparatus 100, where each sensor is configured to detect an operational characteristic or parameter. One such sensor is the surface casing annular pressure sensor 159 described above. The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured for detecting shock and/or vibration in the BHA 170. The apparatus 100 may additionally or alternatively include a mud motor delta pressure ($\Delta P$) sensor 172*a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the controller 190 that is indicative of the torque applied to the bit 175 by the one or more motors 172**.

The apparatus 100 may additionally or alternatively include a toolface sensor **170*c* configured to detect the current toolface orientation. The toolface sensor 170*c* may be or include a conventional or future-developed magnetic toolface sensor which detects toolface orientation relative to magnetic north or true north. Alternatively, or additionally, the toolface sensor 170*c* may be or include a conventional or future-developed gravity toolface sensor which detects toolface orientation relative to the Earth's gravitational field. The toolface sensor 170*c* may also, or alternatively, be or comprise a conventional or future-developed gyro sensor. The apparatus 100 may additionally or alternatively include a WOB sensor 170***d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block, drilling line or dead line anchor may additionally or alternatively include or otherwise be associated with a WOB sensor 140*c* (e.g., one or more sensors installed somewhere in the load path mechanisms to detect WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Figure 2A:
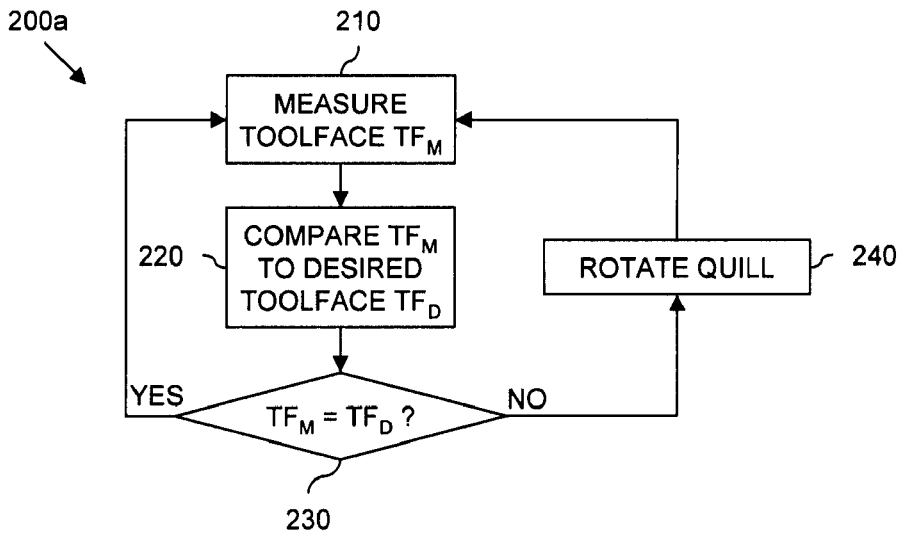
FIG. 2A is a flow-chart diagram of a method according to aspects of the present disclosure.

Referring to FIG. 2A, illustrated is a flow-chart diagram of a method 200*a* according to one or more aspects of the present disclosure. The method 200*a* may be performed in association with one or more components of the apparatus 100 shown in FIG. 1 during operation of the apparatus 100. For example, the method 200*a* may be performed for toolface orientation during drilling operations performed via the apparatus 100.

The method 200*a* includes a step 210 during which the current toolface orientation $TF_M$ is measured. The $TF_M$ may be measured using a conventional or future-developed magnetic toolface sensor which detects toolface orientation relative to magnetic north or true north. Alternatively, or additionally, the $TF_M$ may be measured using a conventional or future-developed gravity toolface sensor which detects toolface orientation relative to the Earth's gravitational field. In an exemplary embodiment, the $TF_M$ may be measured using a magnetic toolface sensor when the end of the wellbore is less than about 7° from vertical, and subsequently measured using a gravity toolface sensor when the end of the wellbore is greater than about 7° from vertical. However, gyros and/or other means for determining the $TF_M$ are also within the scope of the present disclosure.

In a subsequent step 220, the $TF_M$ is compared to a desired toolface orientation $TF_D$. If the $TF_M$ is sufficiently equal to the $TF_D$, as determined during decisional step 230, the method 200*a* is iterated and the step 210 is repeated. "Sufficiently equal" may mean substantially equal, such as varying by no more than a few percentage points, or may alternatively mean varying by no more than a predetermined angle, such as about 5°. Moreover, the iteration of the method 200*a* may be substantially immediate, or there may be a delay period before the method 200*a* is iterated and the step 210 is repeated.

If the $TF_M$ is not sufficiently equal to the $TF_D$, as determined during decisional step 230, the method 200*a* continues to a step 240 during which the quill is rotated by the drive system by, for example, an amount about equal to the difference between the $TF_M$ and the $TF_D$. However, other amounts of rotational adjustment performed during the step 240 are also within the scope of the present disclosure. After step 240 is performed, the method 200*a* is iterated and the step 210 is repeated. Such iteration may be substantially immediate, or there may be a delay period before the method 200*a* is iterated and the step 210 is repeated.

Figure 2B:
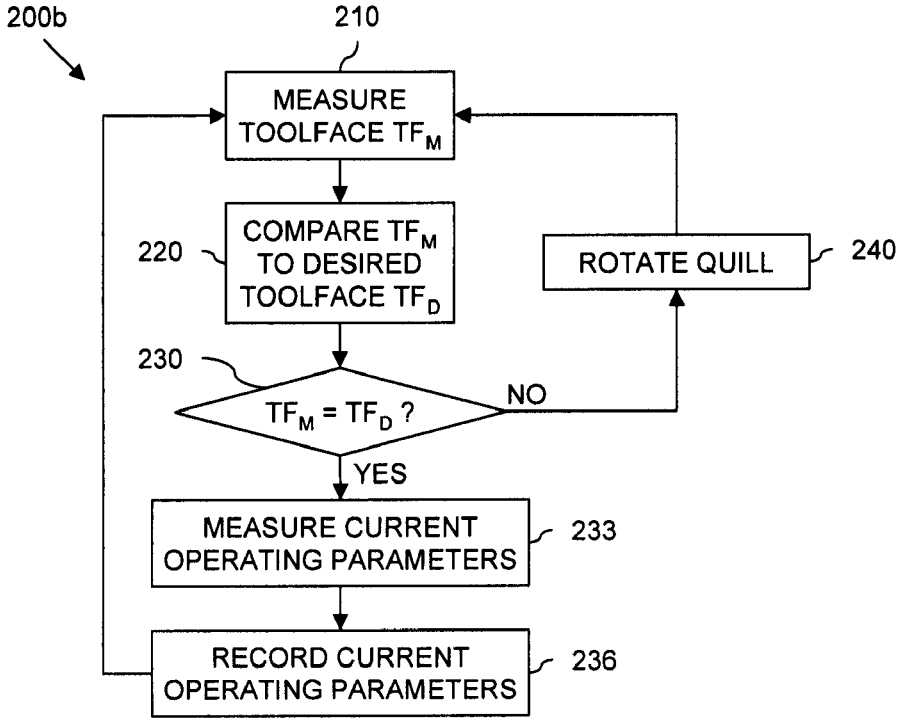
FIG. 2B is a flow-chart diagram of a method according to aspects of the present disclosure.

Referring to FIG. 2B, illustrated is a flow-chart diagram of another embodiment of the method 200*a* shown in FIG. 2A, herein designated by reference numeral 200*b*. The method 200*b* may be performed in association with one or more components of the apparatus 100 shown in FIG. 1 during operation of the apparatus 100. For example, the method 200*b* may be performed for toolface orientation during drilling operations performed via the apparatus 100.

The method 200*b* includes steps 210, 220, 230 and 240 described above with respect to method 200*a* and shown in FIG. 2A. However, the method 200*b* also includes a step 233 during which current operating parameters are measured if the $TF_M$ is sufficiently equal to the $TF_D$, as determined during decisional step 230. Alternatively, or additionally, the current operating parameters may be measured at periodic or scheduled time intervals, or upon the occurrence of other events. The method 200*b* also includes a step 236 during which the operating parameters measured in the step 233 are recorded. The operating parameters recorded during the step 236 may be employed in future calculations of the amount of quill rotation performed during the step 240, such as may be determined by one or more intelligent adaptive controllers, programmable logic controllers, artificial neural networks, and/or other adaptive and/or "learning" controllers or processing apparatus.

Each of the steps of the methods 200*a* and 200*b* may be performed automatically. For example, the controller 190 of FIG. 1 may be configured to automatically perform the toolface comparison of step 230, whether periodically, at random intervals, or otherwise. The controller 190 may also be configured to automatically generate and transmit control signals directing the quill rotation of step 240, such as in response to the toolface comparison performed during steps 220 and 230.

Figure 3:
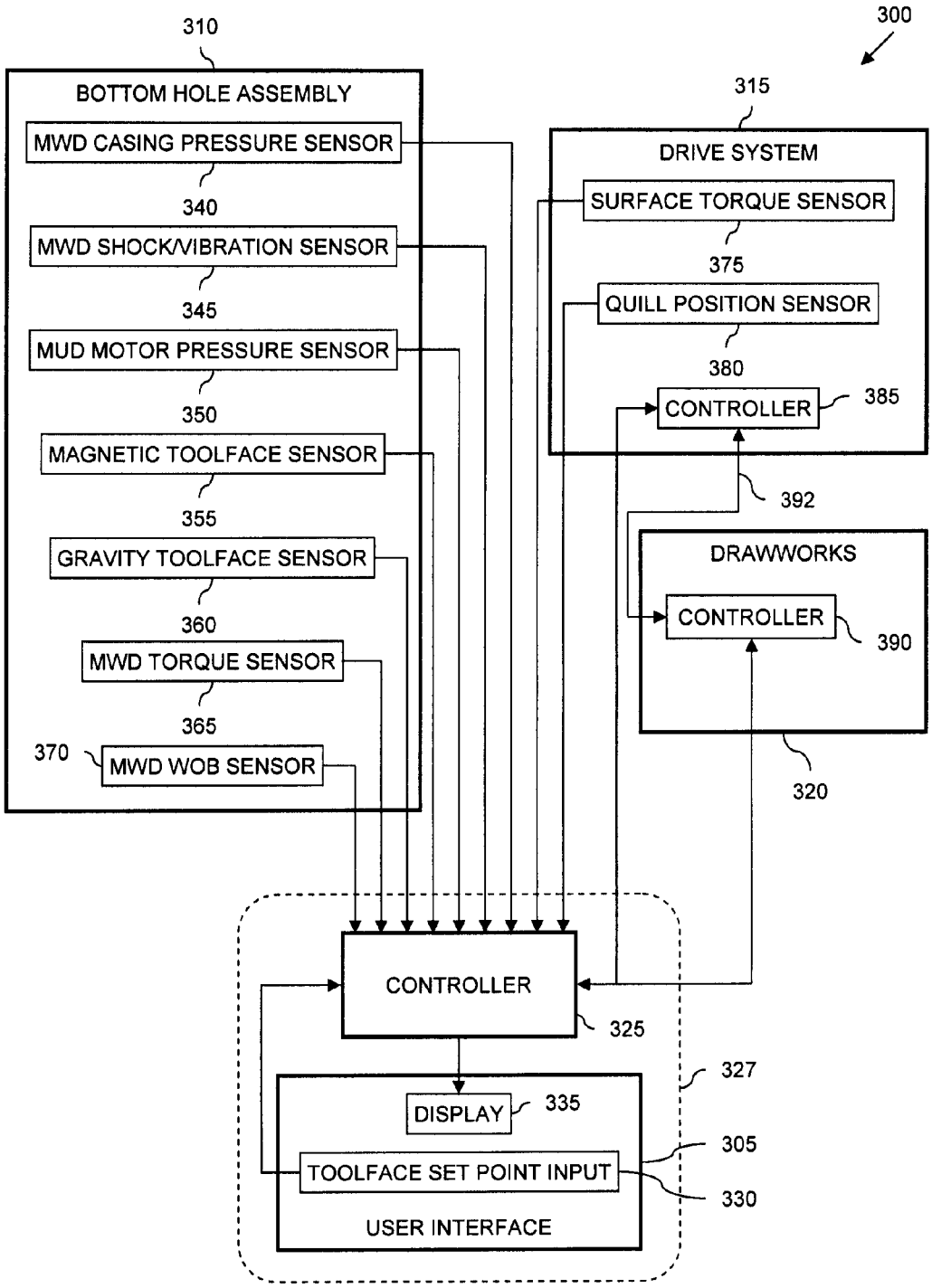
FIG. 3 is a schematic diagram of apparatus according to aspects of the present disclosure.

Referring to FIG. 3, illustrated is a block diagram of an apparatus 300 according to one or more aspects of the present disclosure. The apparatus 300 includes a user interface 305, a BHA 310, a drive system 315, a drawworks 320, and a controller 325. The apparatus 300 may be implemented within the environment and/or apparatus shown in FIG. 1. For example, the BHA 310 may be substantially similar to the BHA 170 shown in FIG. 1, the drive system 315 may be substantially similar to the top drive 140 shown in FIG. 1, the drawworks 320 may be substantially similar to the drawworks 130 shown in FIG. 1, and/or the controller 325 may be substantially similar to the controller 190 shown in FIG. 1. The apparatus 300 may also be utilized in performing the method 200*a* shown in FIG. 2A and/or the method 200*b* shown in FIG. 2B, among other methods described herein or otherwise within the scope of the present disclosure.

The user-interface 305 and the controller 325 may be discrete components that are interconnected via wired or wireless means. Alternatively, the user-interface 305 and the controller 325 may be integral components of a single system or controller 327, as indicated by the dashed lines in FIG. 3.

The user-interface 305 includes means 330 for user-input of one or more toolface set points, and may also include means for user-input of other set points, limits, and other input data. The data input means 330 may include a keypad, voice-recognition apparatus, dial, button, switch, slide selector, toggle, joystick, mouse, data base and/or other conventional or future-developed data input device. Such data input means may support data input from local and/or remote locations. Alternatively, or additionally, the data input means 330 may include means for user-selection of predetermined toolface set point values or ranges, such as via one or more drop-down menus. The toolface set point data may also or alternatively be selected by the controller 325 via the execution of one or more database look-up procedures. In general, the data input means 330 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 305 may also include a display 335 for visually presenting information to the user in textual, graphic, or video form. The display 335 may also be utilized by the user to input the toolface set point data in conjunction with the data input means 330. For example, the toolface set point data input means 330 may be integral to or otherwise communicably coupled with the display 335.

The BHA 310 may include an MWD casing pressure sensor 340 that is configured to detect an annular pressure value or range at or near the MWD portion of the BHA 310, and that may be substantially similar to the pressure sensor 170*a* shown in FIG. 1. The casing pressure data detected via the MWD casing pressure sensor 340 may be sent via electronic signal to the controller 325 via wired or wireless transmission.

The BHA 310 may also include an MWD shock/vibration sensor 345 that is configured to detect shock and/or vibration in the MWD portion of the BHA 310, and that may be substantially similar to the shock/vibration sensor 170*b* shown in FIG. 1. The shock/vibration data detected via the MWD shock/vibration sensor 345 may be sent via electronic signal to the controller 325 via wired or wireless transmission.

The BHA 310 may also include a mud motor ΔP sensor 350 that is configured to detect a pressure differential value or range across the mud motor of the BHA 310, and that may be substantially similar to the mud motor ΔP sensor 172*a* shown in FIG. 1. The pressure differential data detected via the mud motor ΔP sensor 350 may be sent via electronic signal to the controller 325 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 310 may also include a magnetic toolface sensor 355 and a gravity toolface sensor 360 that are cooperatively configured to detect the current toolface, and that collectively may be substantially similar to the toolface sensor 170*c* shown in FIG. 1. The magnetic toolface sensor 355 may be or include a conventional or future-developed magnetic toolface sensor which detects toolface orientation relative to magnetic north or true north. The gravity toolface sensor 360 may be or include a conventional or future-developed gravity toolface sensor which detects toolface orientation relative to the Earth's gravitational field. In an exemplary embodiment, the magnetic toolface sensor 355 may detect the current toolface when the end of the wellbore is less than about 7° from vertical, and the gravity toolface sensor 360 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., sensors 355 and/or 360) may be sent via electronic signal to the controller 325 via wired or wireless transmission.

The BHA 310 may also include an MWD torque sensor 365 that is configured to detect a value or range of values for torque applied to the bit by the motor(s) of the BHA 310, and that may be substantially similar to the torque sensor 172*b* shown in FIG. 1. The torque data detected via the MWD torque sensor 365 may be sent via electronic signal to the controller 325 via wired or wireless transmission.

The BHA 310 may also include an MWD WOB sensor 370 that is configured to detect a value or range of values for WOB at or near the BHA 310, and that may be substantially similar to the WOB sensor 170*d* shown in FIG. 1. The WOB data detected via the MWD WOB sensor 370 may be sent via electronic signal to the controller 325 via wired or wireless transmission.

The drawworks 320 includes a controller 390 and/or other means for controlling feed-out and/or feed-in of a drilling line (such as the drilling line 125 shown in FIG. 1). Such control may include directional control (in vs. out) as well as feed rate. However, exemplary embodiments within the scope of the present disclosure include those in which the drawworks drill string feed off system may alternatively be a hydraulic ram or rack and pinion type hoisting system rig, where the movement of the drill string up and down is via something other than a drawworks. The drill string may also take the form of coiled tubing, in which case the movement of the drill string in and out of the hole is controlled by an injector head which grips and pushes/pulls the tubing in/out of the hole. Nonetheless, such embodiments may still include a version of the controller 390, and the controller 390 may still be configured to control feed-out and/or feed-in of the drill string.

The drive system 315 includes a surface torque sensor 375 that is configured to detect a value or range of the reactive torsion of the quill or drill string, much the same as the torque sensor 140*a* shown in FIG. 1. The drive system 315 also includes a quill position sensor 380 that is configured to detect a value or range of the rotational position of the quill, such as relative to true north or another stationary reference. The surface torsion and quill position data detected via sensors 375 and 380, respectively, may be sent via electronic signal to the controller 325 via wired or wireless transmission. The drive system 315 also includes a controller 385 and/or other means for controlling the rotational position, speed and direction of the quill or other drill string component coupled to the drive system 315 (such as the quill 145 shown in FIG. 1).

In an exemplary embodiment, the drive system 315, controller 385, and/or other component of the apparatus 300 may include means for accounting for friction between the drill string and the wellbore. For example, such friction accounting means may be configured to detect the occurrence and/or severity of the friction, which may then be subtracted from the actual "reactive" torque, perhaps by the controller 385 and/or another control component of the apparatus 300.

The controller 325 is configured to receive one or more of the above-described parameters from the user interface 305, the BHA 310, and/or the drive system 315, and utilize such parameters to continuously, periodically, or otherwise determine the current toolface orientation. The controller 325 may be further configured to generate a control signal, such as via intelligent adaptive control, and provide the control signal to the drive system 315 and/or the drawworks 320 to adjust and/or maintain the toolface orientation. For example, the controller 325 may execute the method 202 shown in FIG. 2B to provide one or more signals to the drive system 315 and/or the drawworks 320 to increase or decrease WOB and/or quill position, such as may be required to accurately "steer" the drilling operation.

Moreover, as in the exemplary embodiment depicted in FIG. 3, the controller 385 of the drive system 315 and/or the controller 390 of the drawworks 320 may be configured to generate and transmit a signal to the controller 325. Consequently, the controller 385 of the drive system 315 may be configured to influence the control of the BHA 310 and/or the drawworks 320 to assist in obtaining and/or maintaining a desired toolface orientation. Similarly, the controller 390 of the drawworks 320 may be configured to influence the control of the BHA 310 and/or the drive system 315 to assist in obtaining and/or maintaining a desired toolface orientation. Alternatively, or additionally, the controller 385 of the drive system 315 and the controller 390 of the drawworks 320 may be configured to communicate directly, such as indicated by the dual-directional arrow 392 depicted in FIG. 3. Consequently, the controller 385 of the drive system 315 and the controller 390 of the drawworks 320 may be configured to cooperate in obtaining and/or maintaining a desired toolface orientation. Such cooperation may be independent of control provided to or from the controller 325 and/or the BHA 310.

Figure 4A:
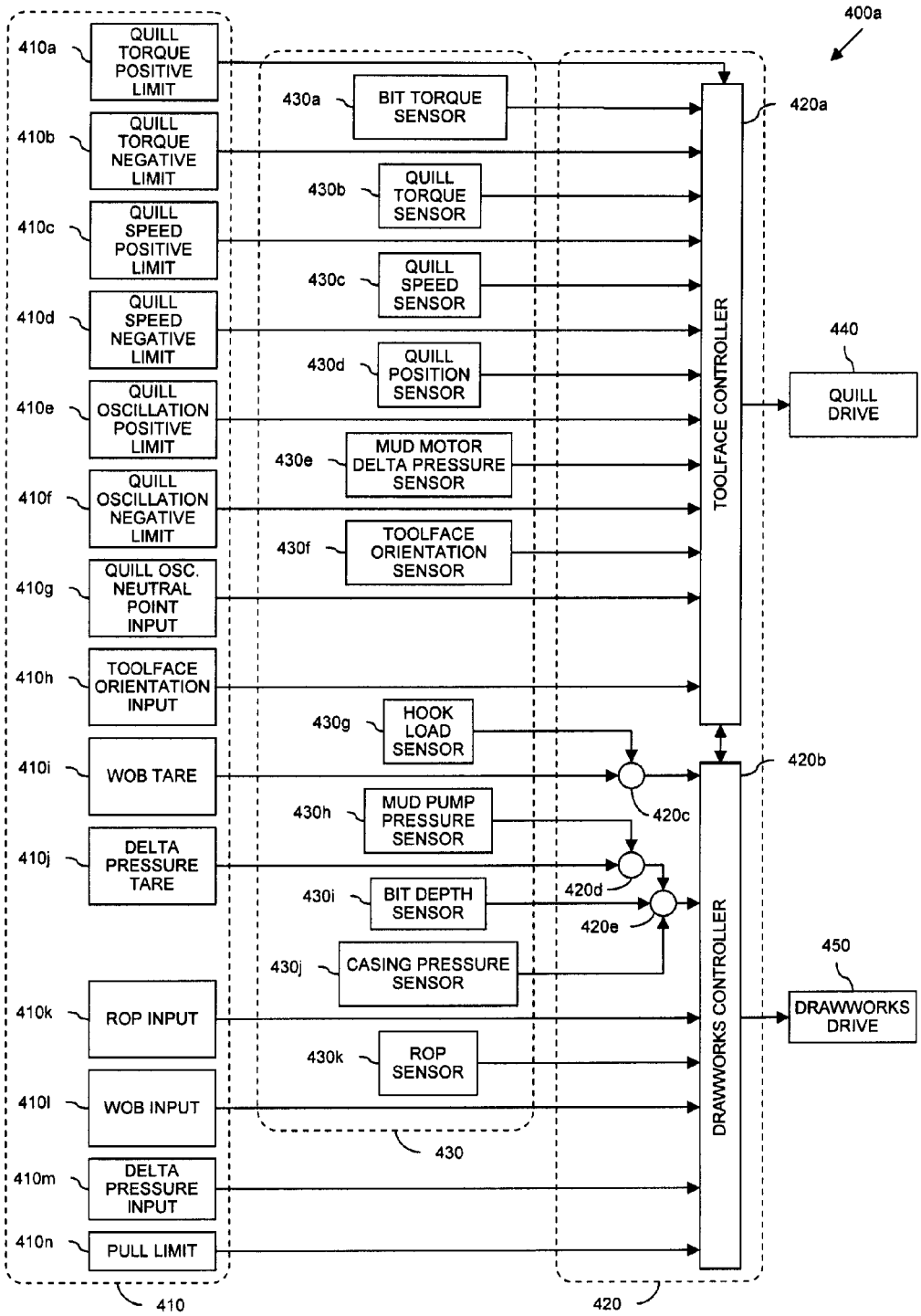
FIG. 4A is a schematic diagram of apparatus according to aspects of the present disclosure.

Referring to FIG. 4A, illustrated is a schematic view of at least a portion of an apparatus 400*a* according to one or more aspects of the present disclosure. The apparatus 400*a* is an exemplary implementation of the apparatus 100 shown in FIG. 1 and/or the apparatus 300 shown in FIG. 3, and is an exemplary environment in which the method 200*a* shown in FIG. 2A and/or the method 200*b* shown in FIG. 2B may be performed. The apparatus 400*a* includes a plurality of user inputs 410 and at least one processor 420. The user inputs 410 include a quill torque positive limit 410*a*, a quill torque negative limit 410*b*, a quill speed positive limit 410*c*, a quill speed negative limit 410*d*, a quill oscillation positive limit 410*e*, a quill oscillation negative limit 410*f*, a quill oscillation neutral point input 410*g*, and a toolface orientation input 410*h*. Other embodiments within the scope of the present disclosure, however, may utilize additional or alternative user inputs 410. The user inputs 410 may be substantially similar to the user input 330 or other components of the user interface 305 shown in FIG. 3. The at least one processor 420 may form at least a portion of, or be formed by at least a portion of, the controller 325 shown in FIG. 3 and/or the controller 385 of the drive system 315 shown in FIG. 3.

In the exemplary embodiment depicted in FIG. 4A, the at least one processor 420 includes a toolface controller 420*a* and a drawworks controller 420*b*, and the apparatus 400*a* also includes or is otherwise associated with a plurality of sensors 430. The plurality of sensors 430 includes a bit torque sensor 430*a*, a quill torque sensor 430*b*, a quill speed sensor 430*c*, a quill position sensor 430*d*, a mud motor ΔP sensor 430*e*, and a toolface orientation sensor 430*f*. Other embodiments within the scope of the present disclosure, however, may utilize additional or alternative sensors 430. In an exemplary embodiment, each of the plurality of sensors 430 may be located at the surface of the wellbore, and not located downhole proximate the bit, the bottom hole assembly, and/or any measurement-while-drilling tools. In other embodiments, however, one or more of the sensors 430 may not be surface sensors. For example, in an exemplary embodiment, the quill torque sensor 430*b*, the quill speed sensor 430*c*, and the quill position sensor 430*d* may be surface sensors, whereas the bit torque sensor 430*a*, the mud motor ΔP sensor 430*e*, and the toolface orientation sensor 430*f* may be downhole sensors (e.g., MWD sensors). Moreover, individual ones of the sensors 430 may be substantially similar to corresponding sensors shown in FIG. 1 or FIG. 3.

The apparatus 400*a* also includes or is associated with a quill drive 440. The quill drive 440 may form at least a portion of a top drive or another rotary drive system, such as the top drive 140 shown in FIG. 1 and/or the drive system 315 shown in FIG. 3. The quill drive 440 is configured to receive a quill drive control signal from the at least one processor 420, if not also from other components of the apparatus 400*a*. The quill drive control signal directs the position (e.g., azimuth), spin direction, spin rate, and/or oscillation of the quill. The toolface controller 420*a* is configured to generate the quill drive control signal, utilizing data received from the user inputs 410 and the sensors 430.

The toolface controller 420*a* may compare the actual torque of the quill to the quill torque positive limit received from the corresponding user input 410*a*. The actual torque of the quill may be determined utilizing data received from the quill torque sensor 430*b*. For example, if the actual torque of the quill exceeds the quill torque positive limit, then the quill drive control signal may direct the quill drive 440 to reduce the torque being applied to the quill. In an exemplary embodiment, the toolface controller 420*a* may be configured to optimize drilling operation parameters related to the actual torque of the quill, such as by maximizing the actual torque of the quill without exceeding the quill torque positive limit.

The toolface controller 420*a* may alternatively or additionally compare the actual torque of the quill to the quill torque negative limit received from the corresponding user input 410*b*. For example, if the actual torque of the quill is less than the quill torque negative limit, then the quill drive control signal may direct the quill drive 440 to increase the torque being applied to the quill. In an exemplary embodiment, the toolface controller 420*a* may be configured to optimize drilling operation parameters related to the actual torque of the quill, such as by minimizing the actual torque of the quill while still exceeding the quill torque negative limit.

The toolface controller 420*a* may alternatively or additionally compare the actual speed of the quill to the quill speed positive limit received from the corresponding user input 410*c*. The actual speed of the quill may be determined utilizing data received from the quill speed sensor 430*c*. For example, if the actual speed of the quill exceeds the quill speed positive limit, then the quill drive control signal may direct the quill drive 440 to reduce the speed at which the quill is being driven. In an exemplary embodiment, the toolface controller 420*a* may be configured to optimize drilling operation parameters related to the actual speed of the quill, such as by maximizing the actual speed of the quill without exceeding the quill speed positive limit.

The toolface controller 420*a* may alternatively or additionally compare the actual speed of the quill to the quill speed negative limit received from the corresponding user input 410*d*. For example, if the actual speed of the quill is less than the quill speed negative limit, then the quill drive control signal may direct the quill drive 440 to increase the speed at which the quill is being driven. In an exemplary embodiment, the toolface controller 420*a* may be configured to optimize drilling operation parameters related to the actual speed of the quill, such as by minimizing the actual speed of the quill while still exceeding the quill speed negative limit.

The toolface controller 420*a* may alternatively or additionally compare the actual orientation (azimuth) of the quill to the quill oscillation positive limit received from the corresponding user input 410*e*. The actual orientation of the quill may be determined utilizing data received from the quill position sensor 430*d*. For example, if the actual orientation of the quill exceeds the quill oscillation positive limit, then the quill drive control signal may direct the quill drive 440 to rotate the quill to within the quill oscillation positive limit, or to modify quill oscillation parameters such that the actual quill oscillation in the positive direction (e.g., clockwise) does not exceed the quill oscillation positive limit. In an exemplary embodiment, the toolface controller 420*a* may be configured to optimize drilling operation parameters related to the actual oscillation of the quill, such as by maximizing the amount of actual oscillation of the quill in the positive direction without exceeding the quill oscillation positive limit.

The toolface controller 420*a* may alternatively or additionally compare the actual orientation of the quill to the quill oscillation negative limit received from the corresponding user input 410*f*. For example, if the actual orientation of the quill is less than the quill oscillation negative limit, then the quill drive control signal may direct the quill drive 440 to rotate the quill to within the quill oscillation negative limit, or to modify quill oscillation parameters such that the actual quill oscillation in the negative direction (e.g., counter-clockwise) does not exceed the quill oscillation negative limit. In an exemplary embodiment, the toolface controller 420*a* may be configured to optimize drilling operation parameters related to the actual oscillation of the quill, such as by maximizing the actual amount of oscillation of the quill in the negative direction without exceeding the quill oscillation negative limit.

The toolface controller 420*a* may alternatively or additionally compare the actual neutral point of quill oscillation to the desired quill oscillation neutral point input received from the corresponding user input 410*g*. The actual neutral point of the quill oscillation may be determined utilizing data received from the quill position sensor 430*d*. For example, if the actual quill oscillation neutral point varies from the desired quill oscillation neutral point by a predetermined amount, or falls outside a desired range of the oscillation neutral point, then the quill drive control signal may direct the quill drive 440 to modify quill oscillation parameters to make the appropriate correction.

The toolface controller 420*a* may alternatively or additionally compare the actual orientation of the toolface to the toolface orientation input received from the corresponding user input 410*h*. The toolface orientation input received from the user input 410*h* may be a single value indicative of the desired toolface orientation. For example, if the actual toolface orientation differs from the toolface orientation input value by a predetermined amount, then the quill drive control signal may direct the quill drive 440 to rotate the quill an amount corresponding to the necessary correction of the toolface orientation. However, the toolface orientation input received from the user input 410*h* may alternatively be a range within which it is desired that the toolface orientation remain. For example, if the actual toolface orientation is outside the toolface orientation input range, then the quill drive control signal may direct the quill drive 440 to rotate the quill an amount necessary to restore the actual toolface orientation to within the toolface orientation input range. In an exemplary embodiment, the actual toolface orientation is compared to a toolface orientation input that is automated, perhaps based on a predetermined and/or constantly updating well plan (e.g., a "well-prog"), possibly taking into account drilling progress path error.

In each of the above-mentioned comparisons and/or calculations performed by the toolface controller, the actual mud motor ΔP, and/or the actual bit torque may also be utilized in the generation of the quill drive signal. The actual mud motor ΔP may be determined utilizing data received from the mud motor ΔP sensor 430*e*, and/or by measurement of pump pressure before the bit is on bottom and tare of this value, and the actual bit torque may be determined utilizing data received from the bit torque sensor 430*a*. Alternatively, the actual bit torque may be calculated utilizing data received from the mud motor ΔP sensor 430*e*, because actual bit torque and actual mud motor ΔP are proportional.

One example in which the actual mud motor ΔP and/or the actual bit torque may be utilized is when the actual toolface orientation cannot be relied upon to provide accurate or fast enough data. For example, such may be the case during "blind" drilling, or other instances in which the driller is no longer receiving data from the toolface orientation sensor 430*f*. In such occasions, the actual bit torque and/or the actual mud motor ΔP can be utilized to determine the actual toolface orientation. For example, if all other drilling parameters remain the same, a change in the actual bit torque and/or the actual mud motor ΔP can indicate a proportional rotation of the toolface orientation in the same or opposite direction of drilling. For example, an increasing torque or ΔP may indicate that the toolface is changing in the opposite direction of drilling, whereas a decreasing torque or ΔP may indicate that the toolface is moving in the same direction as drilling. Thus, in this manner, the data received from the bit torque sensor 430*a* and/or the mud motor ΔP sensor 430*e* can be utilized by the toolface controller 420 in the generation of the quill drive signal, such that the quill can be driven in a manner which corrects for or otherwise takes into account any bit rotation which is indicated by a change in the actual bit torque and/or actual mud motor ΔP.

Moreover, under some operating conditions, the data received by the toolface controller 420 from the toolface orientation sensor 430*f* can lag the actual toolface orientation. For example, the toolface orientation sensor 430*f* may only determine the actual toolface periodically, or a considerable time period may be required for the transmission of the data from the toolface to the surface. In fact, it is not uncommon for such delay to be 30 seconds or more in the systems of the prior art. Consequently, in some implementations within the scope of the present disclosure, it may be more accurate or otherwise advantageous for the toolface controller 420*a* to utilize the actual torque and pressure data received from the bit torque sensor 430*a* and the mud motor ΔP sensor 430*e* in addition to, if not in the alternative to, utilizing the actual toolface data received from the toolface orientation sensor 430*f*.

As shown in FIG. 4A, the user inputs 410 of the apparatus 400*a* may also include a WOB tare 410*i*, a mud motor ΔP tare 410*j*, an ROP input 410*k*, a WOB input 410*l*, a mud motor ΔP input 410*m*, and a hook load limit 410*n*, and the at least one processor 420 may also include a drawworks controller 420*b*. The plurality of sensors 430 of the apparatus 400*a* may also include a hook load sensor 430*g*, a mud pump pressure sensor 430*h*, a bit depth sensor 430*i*, a casing pressure sensor 430*j* and an ROP sensor 430*k*. Each of the plurality of sensors 430 may be located at the surface of the wellbore, downhole (e.g., MWD), or elsewhere.

As described above, the toolface controller 420*a* is configured to generate a quill drive control signal utilizing data received from ones of the user inputs 410 and the sensors 430, and subsequently provide the quill drive control signal to the quill drive 440, thereby controlling the toolface orientation by driving the quill orientation and speed. Thus, the quill drive control signal is configured to control (at least partially) the quill orientation (e.g., azimuth) as well as the speed and direction of rotation of the quill (if any).

The drawworks controller 420*b* is configured to generate a drawworks drum (or brake) drive control signal also utilizing data received from ones of the user inputs 410 and the sensors 430. Thereafter, the drawworks controller 420*b* provides the drawworks drive control signal to the drawworks drive 450, thereby controlling the feed direction and rate of the drawworks. The drawworks drive 450 may form at least a portion of, or may be formed by at least a portion of, the drawworks 130 shown in FIG. 1 and/or the drawworks 320 shown in FIG. 3. The scope of the present disclosure is also applicable or readily adaptable to other means for adjusting the vertical positioning of the drill string. For example, the drawworks controller 420*b* may be a hoist controller, and the drawworks drive 450 may be or include means for hoisting the drill string other than or in addition to a drawworks apparatus (e.g., a rack and pinion apparatus).

The apparatus 400*a* also includes a comparator 420*c* which compares current hook load data with the WOB tare to generate the current WOB. The current hook load data is received from the hook load sensor 430*g*, and the WOB tare is received from the corresponding user input 410*i*.

The drawworks controller 420*b* compares the current WOB with WOB input data. The current WOB is received from the comparator 420*c*, and the WOB input data is received from the corresponding user input 410*l*. The WOB input data received from the user input 410*l* may be a single value indicative of the desired WOB. For example, if the actual WOB differs from the WOB input by a predetermined amount, then the drawworks drive control signal may direct the drawworks drive 450 to feed cable in or out an amount corresponding to the necessary correction of the WOB. However, the WOB input data received from the user input 410*l* may alternatively be a range within which it is desired that the WOB be maintained. For example, if the actual WOB is outside the WOB input range, then the drawworks drive control signal may direct the drawworks drive 450 to feed cable in or out an amount necessary to restore the actual WOB to within the WOB input range. In an exemplary embodiment, the drawworks controller 420*b* may be configured to optimize drilling operation parameters related to the WOB, such as by maximizing the actual WOB without exceeding the WOB input value or range.

The apparatus 400*a* also includes a comparator 420*d* which compares mud pump pressure data with the mud motor ΔP tare to generate an "uncorrected" mud motor ΔP. The mud pump pressure data is received from the mud pump pressure sensor 430*h*, and the mud motor ΔP tare is received from the corresponding user input 410*j*.

The apparatus 400*a* also includes a comparator 420*e* which utilizes the uncorrected mud motor ΔP along with bit depth data and casing pressure data to generate a "corrected" or current mud motor ΔP. The bit depth data is received from the bit depth sensor 430*i*, and the casing pressure data is received from the casing pressure sensor 430*j*. The casing pressure sensor 430*j* may be a surface casing pressure sensor, such as the sensor 159 shown in FIG. 1, and/or a downhole casing pressure sensor, such as the sensor 170*a* shown in FIG. 1, and in either case may detect the pressure in the annulus defined between the casing or wellbore diameter and a component of the drill string.

The drawworks controller 420*b* compares the current mud motor ΔP with mud motor ΔP input data. The current mud motor ΔP is received from the comparator 420*e*, and the mud motor ΔP input data is received from the corresponding user input 410*m*. The mud motor ΔP input data received from the user input 410*m* may be a single value indicative of the desired mud motor ΔP. For example, if the current mud motor ΔP differs from the mud motor ΔP input by a predetermined amount, then the drawworks drive control signal may direct the drawworks drive 450 to feed cable in or out an amount corresponding to the necessary correction of the mud motor ΔP. However, the mud motor ΔP input data received from the user input 410*m* may alternatively be a range within which it is desired that the mud motor ΔP be maintained. For example, if the current mud motor ΔP is outside this range, then the drawworks drive control signal may direct the drawworks drive 450 to feed cable in or out an amount necessary to restore the current mud motor ΔP to within the input range. In an exemplary embodiment, the drawworks controller 420*b* may be configured to optimize drilling operation parameters related to the mud motor ΔP, such as by maximizing the mud motor ΔP without exceeding the input value or range.

The drawworks controller 420*b* may also or alternatively compare actual ROP data with ROP input data. The actual ROP data is received from the ROP sensor 430*k*, and the ROP input data is received from the corresponding user input 410*k*. The ROP input data received from the user input 410*k* may be a single value indicative of the desired ROP. For example, if the actual ROP differs from the ROP input by a predetermined amount, then the drawworks drive control signal may direct the drawworks drive 450 to feed cable in or out an amount corresponding to the necessary correction of the ROP. However, the ROP input data received from the user input 410*k* may alternatively be a range within which it is desired that the ROP be maintained. For example, if the actual ROP is outside the ROP input range, then the drawworks drive control signal may direct the drawworks drive 450 to feed cable in or out an amount necessary to restore the actual ROP to within the ROP input range. In an exemplary embodiment, the drawworks controller 420*b* may be configured to optimize drilling operation parameters related to the ROP, such as by maximizing the actual ROP without exceeding the ROP input value or range.

The drawworks controller 420*b* may also utilize data received from the toolface controller 420*a* when generating the drawworks drive control signal. Changes in the actual WOB can cause changes in the actual bit torque, the actual mud motor ΔP, and the actual toolface orientation. For example, as weight is increasingly applied to the bit, the actual toolface orientation can rotate opposite the direction of drilling, and the actual bit torque and mud motor pressure can proportionally increase. Consequently, the toolface controller 420*a* may provide data to the drawworks controller 420*b* indicating whether the drawworks cable should be fed in or out, and perhaps a corresponding feed rate, as necessary to bring the actual toolface orientation into compliance with the toolface orientation input value or range provided by the corresponding user input 410*h*. In an exemplary embodiment, the drawworks controller 420*b* may also provide data to the toolface controller 420*a* to rotate the quill clockwise or counterclockwise by an amount and/or rate sufficient to compensate for increased or decreased WOB, bit depth, or casing pressure.

As shown in FIG. 4A, the user inputs 410 may also include a pull limit input 410*n*. When generating the drawworks drive control signal, the drawworks controller 420*b* may be configured to ensure that the drawworks does not pull past the pull limit received from the user input 410*n*. The pull limit is also known as a hook load limit, and may be dependent upon the particular configuration of the drilling rig, among other parameters.

In an exemplary embodiment, the drawworks controller 420*b* may also provide data to the toolface controller 420*a* to cause the toolface controller 420*a* to rotate the quill, such as by an amount, direction, and/or rate sufficient to compensate for the pull limit being reached or exceeded. The toolface controller 420*a* may also provide data to the drawworks controller 420*b* to cause the drawworks controller 420*b* to increase or decrease the WOB, or to adjust the drill string feed, such as by an amount, direction, and/or rate sufficient to adequately adjust the toolface orientation.

Figure 4B:
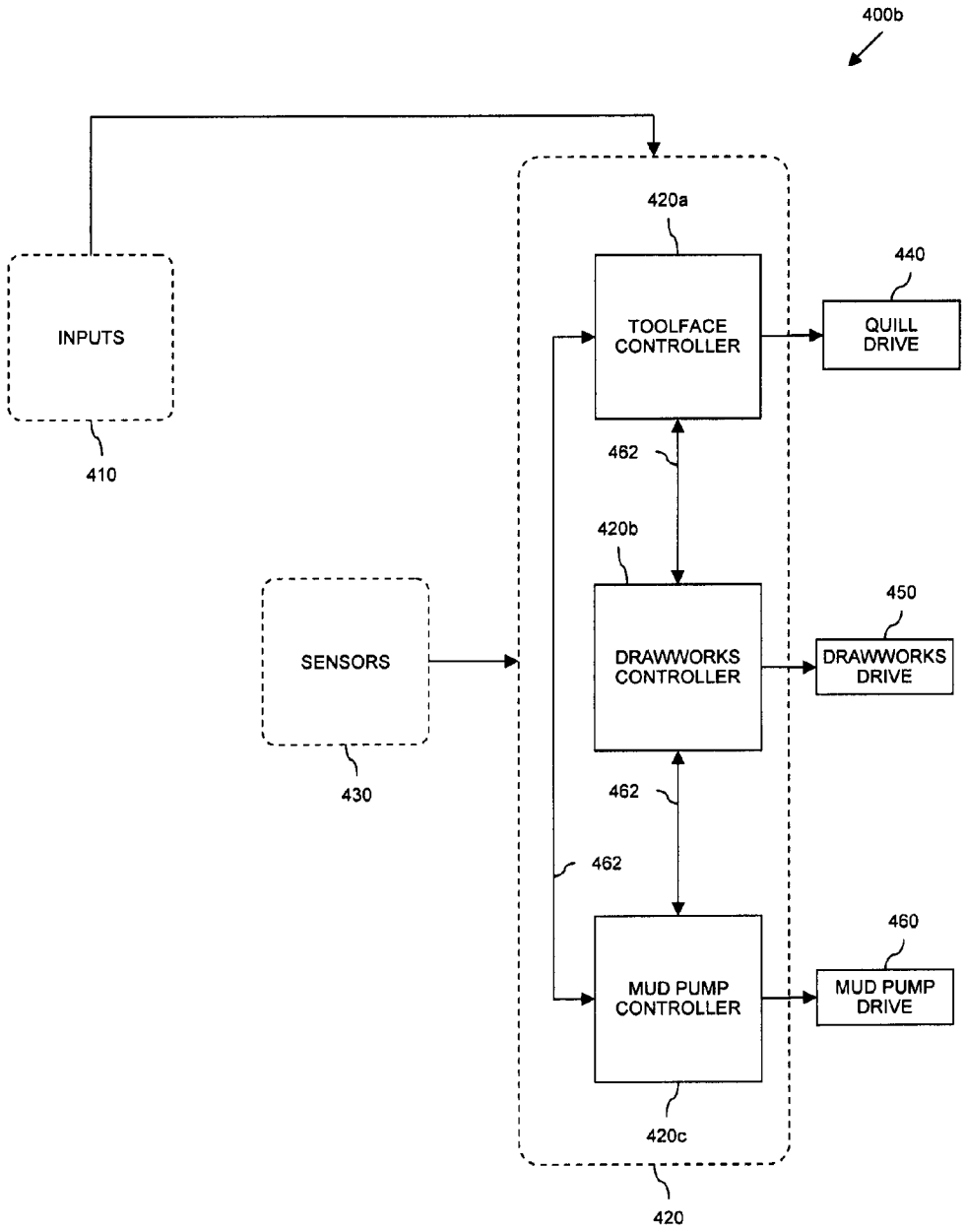
FIG. 4B is a schematic diagram of apparatus according to aspects of the present disclosure.

Referring to FIG. 4B, illustrated is a schematic view of at least a portion of another embodiment of the apparatus 400*a*, herein designated by the reference numeral 400*b*. Like the apparatus 400*a*, the apparatus 400*b* is an exemplary implementation of the apparatus 100 shown in FIG. 1 and/or the apparatus 300 shown in FIG. 3, and is an exemplary environment in which the method 200*a* shown in FIG. 2A and/or the method 200*b* shown in FIG. 2B may be performed.

Like the apparatus 400*a*, the apparatus 400*b* includes the plurality of user inputs 410 and the at least one processor 420. The at least one processor 420 includes the toolface controller 420*a* and the drawworks controller 420*b*, described above, and also a mud pump controller 420*c*. The apparatus 400*b* also includes or is otherwise associated with the plurality of sensors 430, the quill drive 440, and the drawworks drive 450, like the apparatus 400*a*. The apparatus 400*b* also includes or is otherwise associated with a mud pump drive 460, which is configured to control operation of a mud pump, such as the mud pump 180 shown in FIG. 1. In the exemplary embodiment of the apparatus 400*b* shown in FIG. 4B, each of the plurality of sensors 430 may be located at the surface of the wellbore, downhole (e.g., MWD), or elsewhere.

The mud pump controller 420*c* is configured to generate a mud pump drive control signal utilizing data received from ones of the user inputs 410 and the sensors 430. Thereafter, the mud pump controller 420*c* provides the mud pump drive control signal to the mud pump drive 460, thereby controlling the speed, flow rate, and/or pressure of the mud pump. The mud pump controller 420*c* may form at least a portion of, or may be formed by at least a portion of, the controller 190 shown in FIG. 1 and/or the controller 325 shown in FIG. 3.

As described above, the mud motor ΔP may be proportional or otherwise related to toolface orientation, WOB, and/or bit torque. Consequently, the mud pump controller 420*c* may be utilized to influence the actual mud motor ΔP to assist in bringing the actual toolface orientation into compliance with the toolface orientation input value or range provided by the corresponding user input. Such operation of the mud pump controller 420*c* may be independent of the operation of the toolface controller 420*a* and the drawworks controller 420*b*. Alternatively, as depicted by the dual-direction arrows 462 shown in FIG. 4B, the operation of the mud pump controller 420*c* to obtain or maintain a desired toolface orientation may be in conjunction or cooperation with the toolface controller 420*a* and the drawworks controller 420*b*.

The controllers 420*a*, 420*b*, and 420*c* shown in FIGS. 4A and 4B may each be or include intelligent or model-free adaptive controllers, such as those commercially available from CyberSoft, General Cybernation Group, Inc. The controllers 420*a*, 420*b*, and 420*c* may also be collectively or independently implemented on any conventional or future-developed computing device, such as one or more personal computers or servers, hand-held devices, PLC systems, and/or mainframes, among others.

Figure 5A:
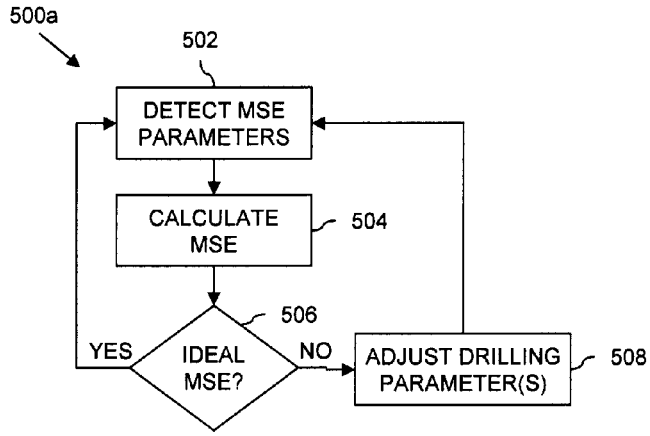
FIG. 5A is a flow-chart diagram of a method according to aspects of the present disclosure.

Referring to FIG. 5A, illustrated is a flow-chart diagram of a method 500*a* according to one or more aspects of the present disclosure. The method 500*a* may be performed in association with one or more components of the apparatus 100 shown in FIG. 1 during operation of the apparatus 100. For example, the method 500*a* may be performed to optimize drilling efficiency during drilling operations performed via the apparatus 100.

The method 500*a* includes a step 502 during which parameters for calculating mechanical specific energy (MSE) are detected, collected, or otherwise obtained. These parameters may be referred to herein as MSE parameters. The MSE parameters include static and dynamic parameters. That is, some MSE parameters change on a substantially continual basis. These dynamic MSE parameters include the weight on bit (WOB), the drill bit rotational speed (RPM), the drill string rotational torque (TOR), and the rate of penetration (ROP) of the drill bit through the formation being drilled. Other MSE parameters change infrequently, such as after tripping out, reaching a new formation type, and changing bit types, among other events. These static MSE parameters include a mechanical efficiency ratio (MER) and the drill bit diameter (DIA).

The MSE parameters may be obtained substantially or entirely automatically, with little or no user input required. For example, during the first iteration through the steps of the method 500*a*, the static MSE parameters may be retrieved via automatic query of a database. Consequently, during subsequent iterations, the static MSE parameters may not require repeated retrieval, such as where the drill bit type or formation data has not changed from the previous iteration of the method 500*a*. Therefore, execution of the step 502 may, in many iterations, require only the detection of the dynamic MSE parameters. The detection of the dynamic MSE parameters may be performed by or otherwise in association with a variety of sensors, such as the sensors shown in FIGS. 1, 3, 4A and/or 4B.

A subsequent step 504 in the method 500*a* includes calculating MSE. In an exemplary embodiment, MSE is calculated according to the following formula:

$$MSE=MER\times[(4\times WOB)/(\pi\times DIA^2)+(480\times RPM\times TOR)/(ROP\times DIA^2)]$$

where:

MSE=mechanical specific energy (pounds per square inch);

MER=mechanical efficiency (ratio);

WOB=weight on bit (pounds);

DIA=drill bit diameter (inches);

RPM=bit rotational speed (rpm);

TOR=drill string rotational torque (foot-pounds); and

ROP=rate of penetration (feet per hour).

MER may also be referred to as a drill bit efficiency factor. In an exemplary embodiment, MER equals 0.35. However, MER may change based on one or more various conditions, such as the bit type, formation type, and/or other factors.

The method 500*a* also includes a decisional step 506, during which the MSE calculated during the previous step 504 is compared to an ideal MSE. The ideal MSE used for comparison during the decisional step 506 may be a single value, such as 100%. Alternatively, the ideal MSE used for comparison during the decisional step 506 may be a target range of values, such as 90-100%. Alternatively, the ideal MSE may be a range of values derived from an advanced analysis of the area being drilled that accounts for the various formations that are being drilled in the current operation.

If it is determined during step 506 that the MSE calculated during step 504 equals the ideal MSE, or falls within the ideal MSE range, the method 500*a* may be iterated by proceeding once again to step 502. However, if it is determined during step 506 that the calculated MSE does not equal the ideal MSE, or does not fall within the ideal MSE range, an additional step 508 is performed. During step 508, one or more operating parameters are adjusted with the intent of bringing the MSE closer to the ideal MSE value or within the ideal MSE range. For example, referring to FIGS. 1 and 5A, collectively, execution of step 508 may include increasing or decreasing WOB, RPM, and/or TOR by transmitting a control signal from the controller 190 to the top drive 140 and/or the draw works 130 to change RPM, TOR, and/or WOB. After step 508 is performed, the method 500*a* may be iterated by proceeding once again to step 502.

Each of the steps of the method 500*a* may be performed automatically. For example, automated detection of dynamic MSE parameters and database look-up of static MSE parameters have already been described above with respect to step 502. The controller 190 of FIG. 1 (and others described herein) may be configured to automatically perform the MSE calculation of step 504, and may also be configured to automatically perform the MSE comparison of decisional step 506, where both the MSE calculation and comparison may be performed periodically, at random intervals, or otherwise. The controller may also be configured to automatically generate and transmit the control signals of step 508, such as in response to the MSE comparison of step 506.

Figure 5B:
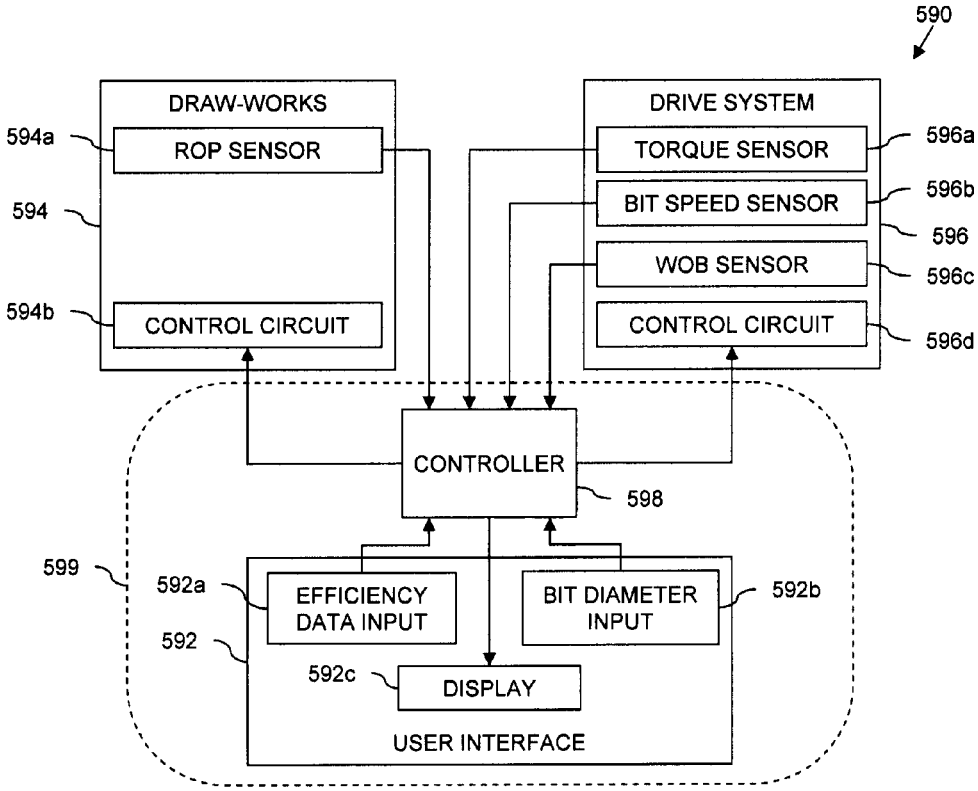
FIG. 5B is a schematic diagram of apparatus according to aspects of the present disclosure.

Referring to FIG. 5B, illustrated is a block diagram of apparatus 590 according to one or more aspects of the present disclosure. Apparatus 590 includes a user interface 592, a draw-works 594, a drive system 596, and a controller 598. Apparatus 590 may be implemented within the environment and/or apparatus shown in FIGS. 1, 3, 4A, and/04 4B. For example, the draw-works 594 may be substantially similar to the draw-works 130 shown in FIG. 1, the drive system 596 may be substantially similar to the top drive 140 shown in FIG. 1, and/or the controller 598 may be substantially similar to the controller 190 shown in FIG. 1. Apparatus 590 may also be utilized in performing the method 200*a* shown in FIG. 2A, the method 200*b* shown in FIG. 2B, and/or the method 500*a* shown in FIG. 5A.

The user-interface 592 and the controller 598 may be discrete components that are interconnected via wired or wireless means. However, the user-interface 592 and the controller 598 may alternatively be integral components of a single system 599, as indicated by the dashed lines in FIG. 5B.

The user-interface 592 includes means 592*a* for user-input of one or more predetermined efficiency data (e.g., MER) values and/or ranges, and means 592*b* for user-input of one or more predetermined bit diameters (e.g., DIA) values and/or ranges. Each of the data input means 592*a* and 592*b* may include a keypad, voice-recognition apparatus, dial, button, switch, slide selector, toggle, joystick, mouse, data base (e.g., with offset information) and/or other conventional or future-developed data input device. Such data input means may support data input from local and/or remote locations. Alternatively, or additionally, the data input means 592*a* and/or 592*b* may include means for user-selection of predetermined MER and DIA values or ranges, such as via one or more drop-down menus. The MER and DIA data may also or alternatively be selected by the controller 598 via the execution of one or more database look-up procedures. In general, the data input means and/or other components within the scope of the present disclosure may support system operation and/or monitoring from stations on the rig site as well as one or more remote locations with a communications link to the system, network, local area network (LAN), wide area network (WAN), Internet, and/or radio, among other means.

The user-interface 592 may also include a display 592*c* for visually presenting information to the user in textual, graphical or video form. The display 592*c* may also be utilized by the user to input the MER and DIA data in conjunction with the data input means 592*a* and 592*b*. For example, the predetermined efficiency and bit diameter data input means 592*a* and 592*b* may be integral to or otherwise communicably coupled with the display 592*c*.

The draw-works 594 includes an ROP sensor 594*a* that is configured for detecting an ROP value or range, and may be substantially similar to the ROP sensor 130*a* shown in FIG. 1. The ROP data detected via the ROP sensor 594*a* may be sent via electronic signal to the controller 598 via wired or wireless transmission. The draw-works 594 also includes a control circuit 594*b* and/or other means for controlling feed-out and/or feed-in of a drilling line (such as the drilling line 125 shown in FIG. 1).

The drive system 596 includes a torque sensor 596*a* that is configured for detecting a value or range of the reactive torsion of the drill string (e.g., TOR), much the same as the torque sensor 140*a* and drill string 155 shown in FIG. 1. The drive system 596 also includes a bit speed sensor 596*b* that is configured for detecting a value or range of the rotational speed of the drill bit within the wellbore (e.g., RPM), much the same as the bit speed sensor 140*b*, drill bit 175 and wellbore 160 shown in FIG. 1. The drive system 596 also includes a WOB sensor 596*c* that is configured for detecting a WOB value or range, much the same as the WOB sensor 140*c* shown in FIG. 1. Alternatively, or additionally, the WOB sensor 596*c* may be located separate from the drive system 596, whether in another component shown in FIG. 5B or elsewhere. The drill string torsion, bit speed, and WOB data detected via sensors 596*a*, 596*b* and 596*c*, respectively, may be sent via electronic signal to the controller 598 via wired or wireless transmission. The drive system 596 also includes a control circuit 596*d* and/or other means for controlling the rotational position, speed and direction of the quill or other drill string component coupled to the drive system 596 (such as the quill 145 shown in FIG. 1). The control circuit 596*d* and/or other component of the drive system 596 may also include means for controlling downhole mud motor(s). Thus, RPM within the scope of the present disclosure may include mud pump flow data converted to downhole mud motor RPM, which may be added to the string RPM to determine total bit RPM.

The controller 598 is configured to receive the above-described MSE parameters from the user interface 592, the draw-works 594, and the drive system 596 and utilize the MSE parameters to continuously, periodically, or otherwise calculate MSE. The controller 598 is further configured to provide a signal to the draw-works 594 and/or the drive system 596 based on the calculated MSE. For example, the controller 6980 may execute the method 200*a* shown in FIG. 2A and/or the method 200*b* shown in FIG. 2B, and consequently provide one or more signals to the draw-works 594 and/or the drive system 596 to increase or decrease WOB and/or bit speed, such as may be required to optimize drilling efficiency (based on MSE).

Figure 5C:
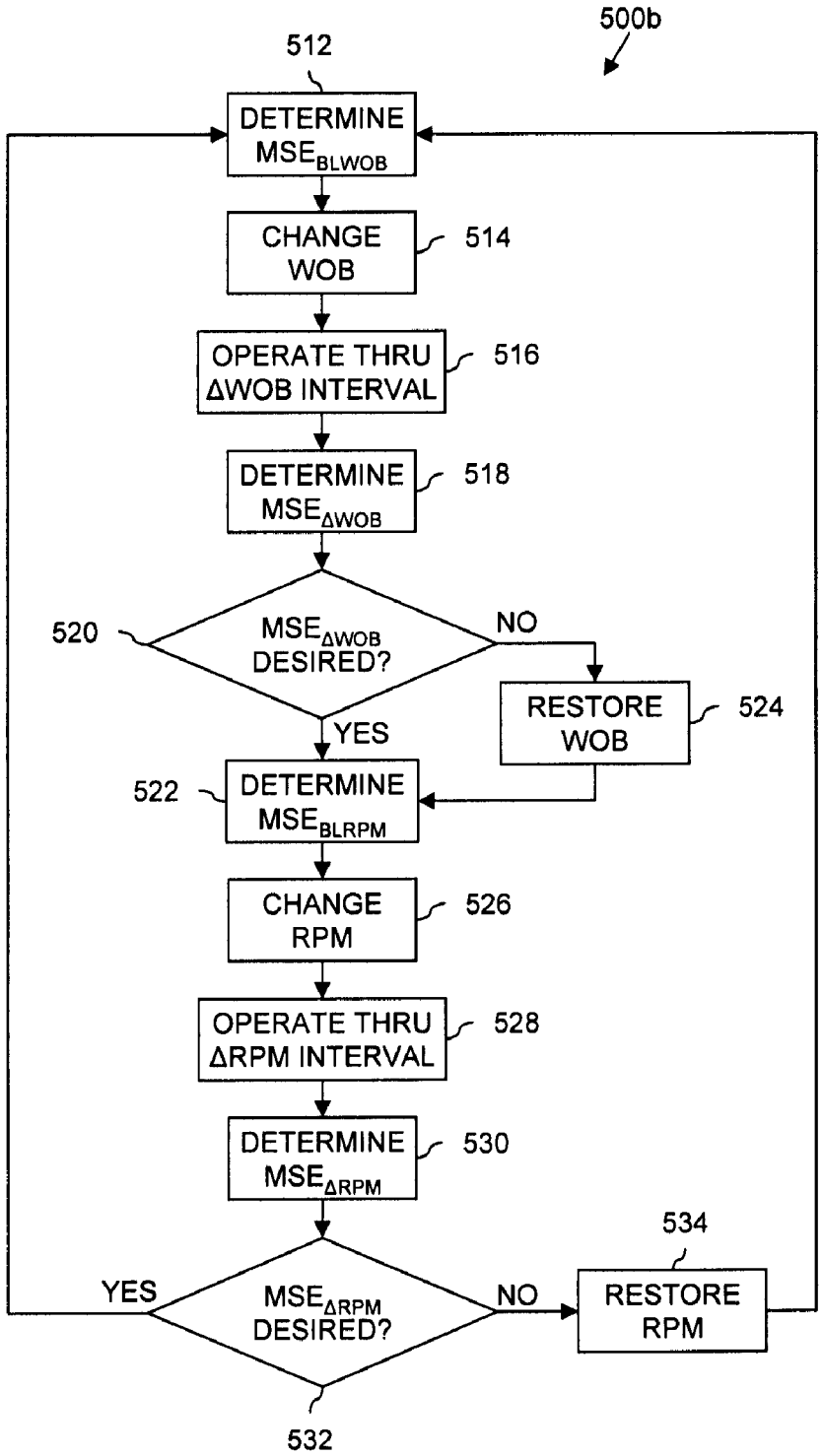
FIG. 5C is a flow-chart diagram of a method according to aspects of the present disclosure.

Referring to FIG. 5C, illustrated is a flow-chart diagram of a method 500*b* for optimizing drilling operation based on real-time calculated MSE according to one or more aspects of the present disclosure. The method 500*b* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B. The method 500*b* may also be performed in conjunction with the performance of the method 200*a* shown in FIG. 2A, the method 200*b* shown in FIG. 2B, and/or the method 500*a* shown in FIG. 5A. The method 500*b* shown in FIG. 5C may comprise or form at least a portion of the method 500*a* shown in FIG. 5A.

During a step 512 of the method 500*b*, a baseline MSE is determined for optimization of drilling efficiency based on MSE by varying WOB. Because the baseline MSE determined in step 512 will be utilized for optimization by varying WOB, the convention $MSE_{BLWOB}$ will be used herein.

In a subsequent step 514, the WOB is changed. Such change can include either increasing or decreasing the WOB. The increase or decrease of WOB during step 514 may be within certain, predefined WOB limits. For example, the WOB change may be no greater than about 10%. However, other percentages are also within the scope of the present disclosure, including where such percentages are within or beyond the predefined WOB limits. The WOB may be manually changed via operator input, or the WOB may be automatically changed via signals transmitted by a controller, control system, and/or other component of the drilling rig and associated apparatus. As above, such signals may be via remote control from another location.

Thereafter, during a step 516, drilling continues with the changed WOB during a predetermined drilling interval ΔWOB. The ΔWOB interval may be a predetermined time period, such as five minutes, ten minutes, thirty minutes, or some other duration. Alternatively, the ΔWOB interval may be a predetermined drilling progress depth. For example, step 516 may comprise continuing drilling operation with the changed WOB until the existing wellbore is extended five feet, ten feet, fifty feet, or some other depth. The ΔWOB interval may also include both a time and a depth component. For example, the ΔWOB interval may comprise drilling for at least thirty minutes or until the wellbore is extended ten feet. In another example, the ΔWOB interval may include drilling until the wellbore is extended twenty feet, but no longer than ninety minutes. Of course, the above-described time and depth values for the ΔWOB interval are merely examples, and many other values are also within the scope of the present disclosure.

After continuing drilling operation through the ΔWOB interval with the changed WOB, a step 518 is performed to determine the $MSE_{\Delta WOB}$ resulting from operating with the changed WOB during the ΔWOB interval. In a subsequent decisional step 520, the changed $MSE_{\Delta WOB}$ is compared to the baseline $MSE_{BLWOB}$. If the changed $MSE_{\Delta WOB}$ is desirable relative to the $MSE_{BLWOB}$, the method 500*b* continues to a step 522. However, if the changed $MSE_{\Delta WOB}$ is not desirable relative to the $MSE_{BLWOB}$, the method 500*b* continues to a step 524 where the WOB is restored to its value before step 514 was performed, and the method then continues to step 522.

The determination made during decisional step 520 may be performed manually or automatically by a controller, control system, and/or other component of the drilling rig and associated apparatus. The determination may comprise finding the $MSE_{\Delta WOB}$ to be desirable if it is substantially equal to and/or less than the $MSE_{BLWOB}$. However, additional or alternative factors may also play a role in the determination made during step 520.

During step 522 of the method 500*b*, a baseline MSE is determined for optimization of drilling efficiency based on MSE by varying the bit rotational speed, RPM. Because the baseline MSE determined in step 522 will be utilized for optimization by varying RPM, the convention $MSE_{BLRPM}$ will be used herein.

In a subsequent step 526, the RPM is changed. Such change can include either increasing or decreasing the RPM. The increase or decrease of RPM during step 526 may be within certain, predefined RPM limits. For example, the RPM change may be no greater than about 10%. However, other percentages are also within the scope of the present disclosure, including where such percentages are within or beyond the predefined RPM limits. The RPM may be manually changed via operator input, or the RPM may be automatically changed via signals transmitted by a controller, control system, and/or other component of the drilling rig and associated apparatus.

Thereafter, during a step 528, drilling continues with the changed RPM during a predetermined drilling interval ΔRPM. The ΔRPM interval may be a predetermined time period, such as five minutes, ten minutes, thirty minutes, or some other duration. Alternatively, the ΔRPM interval may be a predetermined drilling progress depth. For example, step 528 may comprise continuing drilling operation with the changed RPM until the existing wellbore is extended five feet, ten feet, fifty feet, or some other depth. The ΔRPM interval may also include both a time and a depth component. For example, the ΔRPM interval may comprise drilling for at least thirty minutes or until the wellbore is extended ten feet. In another example, the ΔRPM interval may include drilling until the wellbore is extended twenty feet, but no longer than ninety minutes. Of course, the above-described time and depth values for the ΔRPM interval are merely examples, and many other values are also within the scope of the present disclosure.

After continuing drilling operation through the ΔRPM interval with the changed RPM, a step 530 is performed to determine the $MSE_{\Delta RPM}$ resulting from operating with the changed RPM during the ΔRPM interval. In a subsequent decisional step 532, the changed $MSE_{\Delta RPM}$ is compared to the baseline $MSE_{BLRPM}$. If the changed $MSE_{\Delta RPM}$ is desirable relative to the $MSE_{BLRPM}$, the method 500*b* returns to step 512. However, if the changed $MSE_{\Delta RPM}$ is not desirable relative to the $MSE_{BLRPM}$, the method 500*b* continues to step 534 where the RPM is restored to its value before step 526 was performed, and the method then continues to step 512.

The determination made during decisional step 532 may be performed manually or automatically by a controller, control system, and/or other component of the drilling rig and associated apparatus. The determination may comprise finding the $MSE_{\Delta RPM}$ to be desirable if it is substantially equal to and/or less than the $MSE_{BLRPM}$. However, additional or alternative factors may also play a role in the determination made during step 532.

Moreover, after steps 532 and/or 534 are performed, the method 500*b* may not immediately return to step 512 for a subsequent iteration. For example, a subsequent iteration of the method 500*b* may be delayed for a predetermined time interval or drilling progress depth. Alternatively, the method 500*b* may end after the performance of steps 532 and/or 534.

Figure 5D:
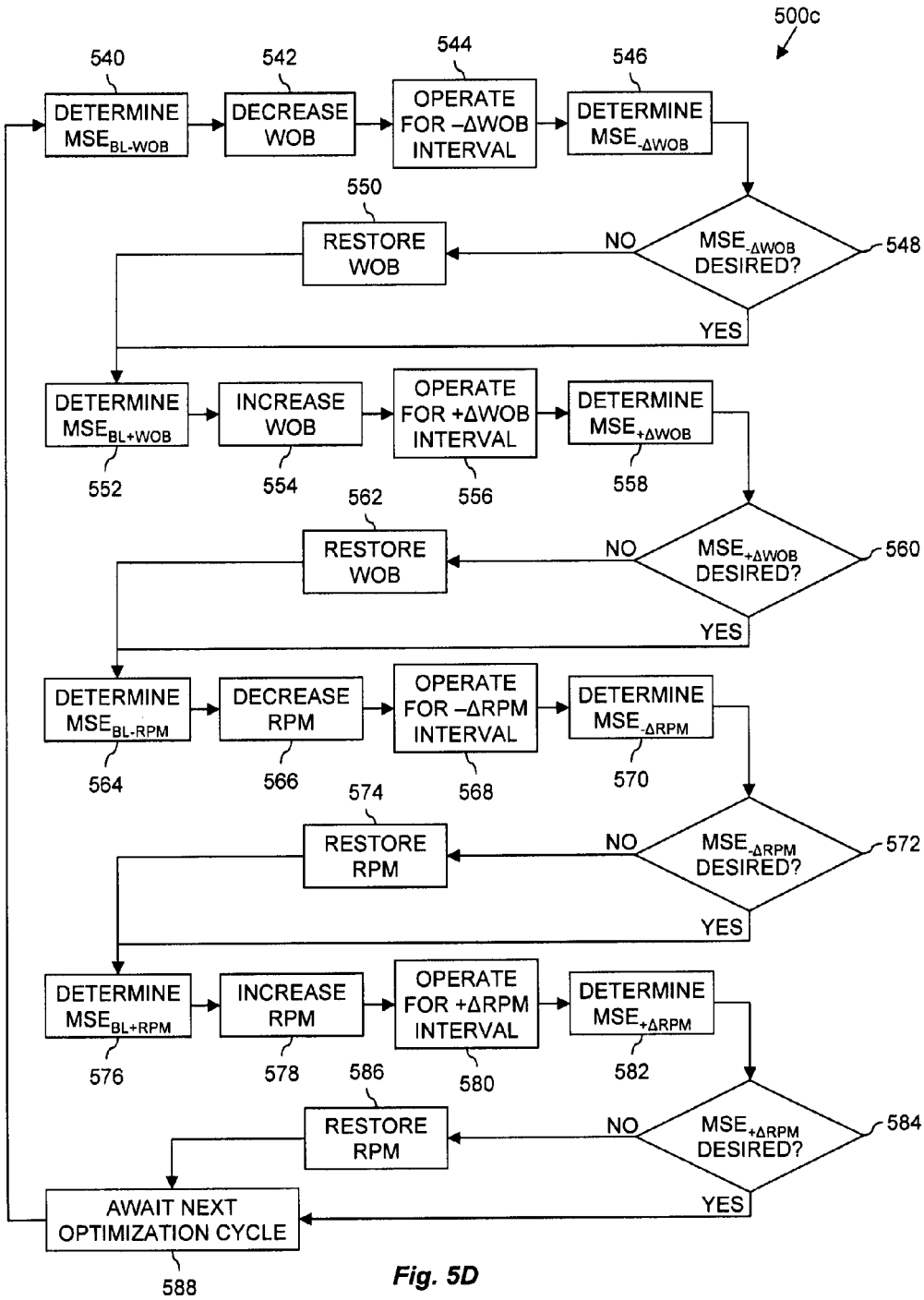
FIG. 5D is a flow-chart diagram of a method according to aspects of the present disclosure.

Referring to FIG. 5D, illustrated is a flow-chart diagram of a method 500*c* for optimizing drilling operation based on real-time calculated MSE according to one or more aspects of the present disclosure. The method 500*c* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B. The method 500*c* may also be performed in conjunction with the performance of the method 200*a* shown in FIG. 2A, the method 200*b* shown in FIG. 2B, the method 500*a* shown in FIG. 5A, and/or the method 500*b* shown in FIG. 5C. The method 500*c* shown in FIG. 5D may comprise or form at least a portion of the method 500*a* shown in FIG. 5A and/or the method 500*b* shown in FIG. 5C.

During a step 540 of the method 500*c*, a baseline MSE is determined for optimization of drilling efficiency based on MSE by decreasing WOB. Because the baseline MSE determined in step 540 will be utilized for optimization by decreasing WOB, the convention $MSE_{BL-WOB}$ will be used herein.

In a subsequent step 542, the WOB is decreased. The decrease of WOB during step 542 may be within certain, predefined WOB limits. For example, the WOB decrease may be no greater than about 10%. However, other percentages are also within the scope of the present disclosure, including where such percentages are within or beyond the predefined WOB limits. The WOB may be manually decreased via operator input, or the WOB may be automatically decreased via signals transmitted by a controller, control system, and/or other component of the drilling rig and associated apparatus.

Thereafter, during a step 544, drilling continues with the decreased WOB during a predetermined drilling interval −ΔWOB. The −ΔWOB interval may be a predetermined time period, such as five minutes, ten minutes, thirty minutes, or some other duration. Alternatively, the −ΔWOB interval may be a predetermined drilling progress depth. For example, step 544 may comprise continuing drilling operation with the decreased WOB until the existing wellbore is extended five feet, ten feet, fifty feet, or some other depth. The −ΔWOB interval may also include both a time and a depth component. For example, the −ΔWOB interval may comprise drilling for at least thirty minutes or until the wellbore is extended ten feet. In another example, the −ΔWOB interval may include drilling until the wellbore is extended twenty feet, but no longer than ninety minutes. Of course, the above-described time and depth values for the −ΔWOB interval are merely examples, and many other values are also within the scope of the present disclosure.

After continuing drilling operation through the −ΔWOB interval with the decreased WOB, a step 546 is performed to determine the $MSE_{-\Delta WOB}$ resulting from operating with the decreased WOB during the −ΔWOB interval. In a subsequent decisional step 548, the decreased $MSE_{-\Delta WOB}$ is compared to the baseline $MSE_{BL-WOB}$. If the decreased $MSE_{-\Delta WOB}$ is desirable relative to the $MSE_{BL-WOB}$, the method 500*c* continues to a step 552. However, if the decreased $MSE_{-\Delta WOB}$ is not desirable relative to the $MSE_{BL-WOB}$, the method 500*c* continues to a step 550 where the WOB is restored to its value before step 542 was performed, and the method then continues to step 552.

The determination made during decisional step 548 may be performed manually or automatically by a controller, control system, and/or other component of the drilling rig and associated apparatus. The determination may comprise finding the $MSE_{-\Delta WOB}$ to be desirable if it is substantially equal to and/or less than the $MSE_{BL-WOB}$. However, additional or alternative factors may also play a role in the determination made during step 548.

During step 552 of the method 500*c*, a baseline MSE is determined for optimization of drilling efficiency based on MSE by increasing the WOB. Because the baseline MSE determined in step 552 will be utilized for optimization by increasing WOB, the convention $MSE_{BL+WOB}$ will be used herein.

In a subsequent step 554, the WOB is increased. The increase of WOB during step 554 may be within certain, predefined WOB limits. For example, the WOB increase may be no greater than about 10%. However, other percentages are also within the scope of the present disclosure, including where such percentages are within or beyond the predefined WOB limits. The WOB may be manually increased via operator input, or the WOB may be automatically increased via signals transmitted by a controller, control system, and/or other component of the drilling rig and associated apparatus.

Thereafter, during a step 556, drilling continues with the increased WOB during a predetermined drilling interval +ΔWOB. The +ΔWOB interval may be a predetermined time period, such as five minutes, ten minutes, thirty minutes, or some other duration. Alternatively, the +ΔWOB interval may be a predetermined drilling progress depth. For example, step 556 may comprise continuing drilling operation with the increased WOB until the existing wellbore is extended five feet, ten feet, fifty feet, or some other depth. The +ΔWOB interval may also include both a time and a depth component. For example, the +ΔWOB interval may comprise drilling for at least thirty minutes or until the wellbore is extended ten feet. In another example, the +ΔWOB interval may include drilling until the wellbore is extended twenty feet, but no longer than ninety minutes.

After continuing drilling operation through the +ΔWOB interval with the increased WOB, a step 558 is performed to determine the $MSE_{+\Delta WOB}$ resulting from operating with the increased WOB during the +ΔWOB interval. In a subsequent decisional step 560, the changed $MSE_{+\Delta WOB}$ is compared to the baseline $MSE_{BL+WOB}$. If the changed $MSE_{+\Delta WOB}$ is desirable relative to the $MSE_{BL+WOB}$, the method 500*c* continues to a step 564. However, if the changed $MSE_{+\Delta WOB}$ is not desirable relative to the $MSE_{BL+WOB}$, the method 500*c* continues to a step 562 where the WOB is restored to its value before step 554 was performed, and the method then continues to step 564.

The determination made during decisional step 560 may be performed manually or automatically by a controller, control system, and/or other component of the drilling rig and associated apparatus. The determination may comprise finding the $MSE_{+\Delta WOB}$ to be desirable if it is substantially equal to and/or less than the $MSE_{BL+WOB}$. However, additional or alternative factors may also play a role in the determination made during step 560.

During step 564 of the method 500*c*, a baseline MSE is determined for optimization of drilling efficiency based on MSE by decreasing the bit rotational speed, RPM. Because the baseline MSE determined in step 564 will be utilized for optimization by decreasing RPM, the convention $MSE_{BL-RPM}$ will be used herein.

In a subsequent step 566, the RPM is decreased. The decrease of RPM during step 566 may be within certain, predefined RPM limits. For example, the RPM decrease may be no greater than about 10%. However, other percentages are also within the scope of the present disclosure, including where such percentages are within or beyond the predefined RPM limits. The RPM may be manually decreased via operator input, or the RPM may be automatically decreased via signals transmitted by a controller, control system, and/or other component of the drilling rig and associated apparatus.

Thereafter, during a step 568, drilling continues with the decreased RPM during a predetermined drilling interval −ΔRPM. The −ΔRPM interval may be a predetermined time period, such as five minutes, ten minutes, thirty minutes, or some other duration. Alternatively, the −ΔRPM interval may be a predetermined drilling progress depth. For example, step 568 may comprise continuing drilling operation with the decreased RPM until the existing wellbore is extended five feet, ten feet, fifty feet, or some other depth.

The −ΔRPM interval may also include both a time and a depth component. For example, the −ΔRPM interval may comprise drilling for at least thirty minutes or until the wellbore is extended ten feet. In another example, the −ΔRPM interval may include drilling until the wellbore is extended twenty feet, but no longer than ninety minutes.

After continuing drilling operation through the −ΔRPM interval with the decreased RPM, a step 570 is performed to determine the $MSE_{-\Delta RPM}$ resulting from operating with the decreased RPM during the −ΔRPM interval. In a subsequent decisional step 572, the decreased $MSE_{-\Delta RPM}$ is compared to the baseline $MSE_{BL-RPM}$. If the changed $MSE_{-\Delta RPM}$ is desirable relative to the $MSE_{BL-RPM}$, the method 500*c* continues to a step 576. However, if the changed $MSE_{-\Delta RPM}$ is not desirable relative to the $MSE_{BL-RPM}$, the method 500*c* continues to a step 574 where the RPM is restored to its value before step 566 was performed, and the method then continues to step 576.

The determination made during decisional step 572 may be performed manually or automatically by a controller, control system, and/or other component of the drilling rig and associated apparatus. The determination may comprise finding the $MSE_{-\Delta RPM}$ to be desirable if it is substantially equal to and/or less than the $MSE_{BL-RPM}$. However, additional or alternative factors may also play a role in the determination made during step 572.

During step 576 of the method 500*c*, a baseline MSE is determined for optimization of drilling efficiency based on MSE by increasing the bit rotational speed, RPM. Because the baseline MSE determined in step 576 will be utilized for optimization by increasing RPM, the convention $MSE_{+RPM}$ will be used herein.

In a subsequent step 578, the RPM is increased. The increase of RPM during step 578 may be within certain, predefined RPM limits. For example, the RPM increase may be no greater than about 10%. However, other percentages are also within the scope of the present disclosure, including where such percentages are within or beyond the predefined RPM limits. The RPM may be manually increased via operator input, or the RPM may be automatically increased via signals transmitted by a controller, control system, and/or other component of the drilling rig and associated apparatus.

Thereafter, during a step 580, drilling continues with the increased RPM during a predetermined drilling interval +ΔRPM. The +ΔRPM interval may be a predetermined time period, such as five minutes, ten minutes, thirty minutes, or some other duration. Alternatively, the +ΔRPM interval may be a predetermined drilling progress depth. For example, step 580 may comprise continuing drilling operation with the increased RPM until the existing wellbore is extended five feet, ten feet, fifty feet, or some other depth. The +ΔRPM interval may also include both a time and a depth component. For example, the +ΔRPM interval may comprise drilling for at least thirty minutes or until the wellbore is extended ten feet. In another example, the +ΔRPM interval may include drilling until the wellbore is extended twenty feet, but no longer than ninety minutes.

After continuing drilling operation through the +ΔRPM interval with the increased RPM, a step 582 is performed to determine the $MSE_{+\Delta RPM}$ resulting from operating with the increased RPM during the +ΔRPM interval. In a subsequent decisional step 584, the increased $MSE_{+\Delta RPM}$ is compared to the baseline $MSE_{+RPM}$. If the changed $MSE_{+\Delta RPM}$ is desirable relative to the $MSE_{+RPM}$, the method 500*c* continues to a step 588. However, if the changed $MSE_{+\Delta RPM}$ is not desirable relative to the $MSE_{+RPM}$, the method 500*c* continues to a step 586 where the RPM is restored to its value before step 578 was performed, and the method then continues to step 588.

The determination made during decisional step 584 may be performed manually or automatically by a controller, control system, and/or other component of the drilling rig and associated apparatus. The determination may comprise finding the $MSE_{+\Delta RPM}$ to be desirable if it is substantially equal to and/or less than the $MSE_{+RPM}$. However, additional or alternative factors may also play a role in the determination made during step 584.

Step 588 comprises awaiting a predetermined time period or drilling depth interval before reiterating the method 500*c* by returning to step 540. However, in an exemplary embodiment, the interval may be as small as 0 seconds or 0 feet, such that the method returns to step 540 substantially immediately after performing steps 584 and/or 586. Alternatively, the method 500*c* may not require iteration, such that the method 500*c* may substantially end after the performance of steps 584 and/or 586.

Moreover, the drilling intervals −ΔWOB, +ΔWOB, −ΔRPM and +ΔROM may each be substantially identical within a single iteration of the method 500*c*. Alternatively, one or more of the intervals may vary in duration or depth relative to the other intervals. Similarly, the amount that the WOB is decreased and increased in steps 542 and 554 may be substantially identical or may vary relative to each other within a single iteration of the method 500*c*. The amount that the RPM is decreased and increased in steps 566 and 578 may be substantially identical or may vary relative to each other within a single iteration of the method 500*c*. The WOB and RPM variances may also change or stay the same relative to subsequent iterations of the method 500*c*.

As described above, one or more aspects of the present disclosure may be utilized for drilling operation or control based on MSE. However, one or more aspects of the present disclosure may additionally or alternatively be utilized for drilling operation or control based on ΔT. That is, as described above, during drilling operation, torque is transmitted from the top drive or other rotary drive to the drill string. The torque required to drive the bit may be referred to as the Torque On Bit (TOB), and may be monitored utilizing a sensor such as the torque sensor 140*a* shown in FIG. 1, the torque sensor 355 shown in FIG. 3, one or more of the sensors 430 shown in FIGS. 4A and 4B, the torque sensor 596*a* shown in FIG. 5B, and/or one or more torque sensing devices of the BHA.

The drill string undergoes various types of vibration during drilling, including axial (longitudinal) vibrations, bending (lateral) vibrations, and torsional (rotational) vibrations. The torsional vibrations are caused by nonlinear interaction between the bit, the drill string, and the wellbore. As described above, this torsional vibration can include stick-slip vibration, characterized by alternating stops (during which the BHA "sticks" to the wellbore) and intervals of large angular velocity of the BHA (during which the BHA "slips" relative to the wellbore).

The stick-slip behavior of the BHA causes real-time variations of TOB, or ΔT. This ΔT may be utilized to support a Stick Slip Alarm (SSA) according to one or more aspects of the present disclosure. For example, a ΔT or SSA parameter may be displayed visually with a "Stop Light" indicator, where a green light may indicate an acceptable operating condition (e.g., SSA parameter of 0-15), an amber light may indicate that stick-slip behavior is imminent (e.g., SSA parameter of 16-25), and a red light may indicate that stick-slip behavior is likely occurring (e.g., SSA parameter above 25). However, these example thresholds may be adjustable during operation, as they may change with the drilling conditions. The ΔT or SSA parameter may alternatively or additionally be displayed graphically (e.g., showing current and historical data), audibly (e.g., via an annunciator), and/or via a meter or gauge display. Combinations of these display options are also within the scope of the present disclosure. For example, the above-described "Stop Light" indicator may continuously indicate the SSA parameter regardless of its value, and an audible alarm may be triggered if the SSA parameter exceeds a predetermined value (e.g., 25).

A drilling operation controller or other apparatus within the scope of the present disclosure may have integrated therein one or more aspects of drilling operation or control based on ΔT or the SSA parameter as described above. For example, a controller such as the controller 190 shown in FIG. 1, the controller 325 shown in FIG. 3, controller 420 shown in FIG. 4A or 4B, and/or the controller 598 shown in FIG. 5B may be configured to automatically adjust the drill string RPM with a short burst of increased or decreased RPM (e.g., +/−5 RPM) to disrupt the harmonic of stick-slip vibration, either prior to or when stick-slip is detected, and then return to normal RPM. The controller may be configured to automatically step RPM up or down by a predetermined or user-adjustable quantity or percentage for a predetermined or user-adjustable duration, in attempt to move drilling operation out of the harmonic state. Alternatively, the controller may be configured to automatically continue to adjust RPM up or down incrementally until the ΔT or SSA parameter indicates that the stick-slip operation has been halted.

In an exemplary embodiment, the ΔT or SSA-enabled controller may be further configured to automatically reduce WOB if stick slip is severe, such as may be due to an excessively high target WOB. Such automatic WOB reduction may comprise a single adjustment or incremental adjustments, whether temporary or long-term, and which may be sustained until the ΔT or SSA parameter indicates that the stick-slip operation has been halted.

The ΔT or SSA-enabled controller may be further configured to automatically increase WOB, such as to find the upper WOB stick-slip limit. For example, if all other possible drilling parameters are optimized or adjusted to within corresponding limits, the controller may automatically increase WOB incrementally until the ΔT or SSA parameter nears or equals its upper limit (e.g., 25).

In an exemplary embodiment, ΔT-based drilling operation or control according to one or more aspects of the present disclosure may function according to one or more aspects of the following pseudo-code:

```
IF (counter <= Process_Time)
    IF (counter = = 1)
        Minimum_Torque = Realtime_Torque
        PRINT ("Minimum", Minimum_Torque)
        Maximum_Torque = Realtime_Torque
        PRINT ("Maximum", Maximum_Torque)
    END
    IF (Realtime_Torque < Minimum_Torque)
        Minimum_Torque = Realtime_Torque
    END
    IF (Maximum_Torque < Realtime_Torque)
        Maximum_Torque = Realtime_Torque
    END
    Torque_counter = (Torque_counter +
    Realtime_Torque)
    Average_Torque = (Torque_counter/counter)
    counter = counter + 1
    PRINT ("Process_Time", Process_Time)
ELSE
    SSA = ((Maximum_Torque − Minimum_Torque)/
    Average_Torque) * 100
```

where Process_Time is the time elapsed since monitoring of the ΔT or SSA parameter commenced, Minimum_Torque is the minimum TOB which occurred during Process_Time, Maximum_Torque is the maximum TOB which occurred during Process_Time, Realtime_Torque is current TOB, Average_Torque is the average TOB during Process_Time, and SSA is the Stick-Slip Alarm parameter.

Figure 6A:
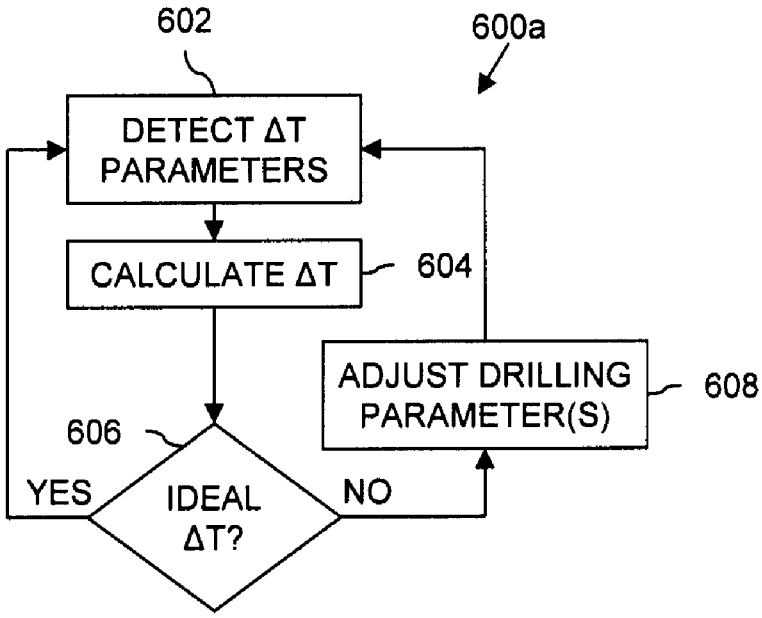
FIG. 6A is a flow-chart diagram of a method according to aspects of the present disclosure.

As described above, the ΔT or SSA parameter may be utilized within or otherwise according to the method 200*a* shown in FIG. 2A, the method 200*b* shown in FIG. 2B, the method 500*a* shown in FIG. 5A, the method 500*b* shown in FIG. 5C, and/or the method 500*c* shown in FIG. 5D. For example, as shown in FIG. 6A, the ΔT or SSA parameter may be substituted for the MSE parameter described above with reference to FIG. 5A. Alternatively, the ΔT or SSA parameter may be monitored in addition to the MSE parameter described above with reference to FIG. 5A, such that drilling operation or control is based on both MSE and the ΔT or SSA parameter.

Referring to FIG. 6A, illustrated is a flow-chart diagram of a method 600*a* according to one or more aspects of the present disclosure. The method 600*a* may be performed in association with one or more components of the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B, during operation thereof.

The method 600*a* includes a step 602 during which current ΔT parameters are measured. In a subsequent step 604, the ΔT is calculated. If the ΔT is sufficiently equal to the desired ΔT or otherwise ideal, as determined during decisional step 606, the method 600*a* is iterated and the step 602 is repeated. "Ideal" may be as described above. The iteration of the method 600*a* may be substantially immediate, or there may be a delay period before the method 600*a* is iterated and the step 602 is repeated. If the ΔT is not ideal, as determined during decisional step 606, the method 600*a* continues to a step 608 during which one or more drilling parameters (e.g., WOB, RPM, etc.) are adjusted in attempt to improve the ΔT. After step 608 is performed, the method 600*a* is iterated and the step 602 is repeated. Such iteration may be substantially immediate, or there may be a delay period before the method 600*a* is iterated and the step 602 is repeated.

Figure 6B:
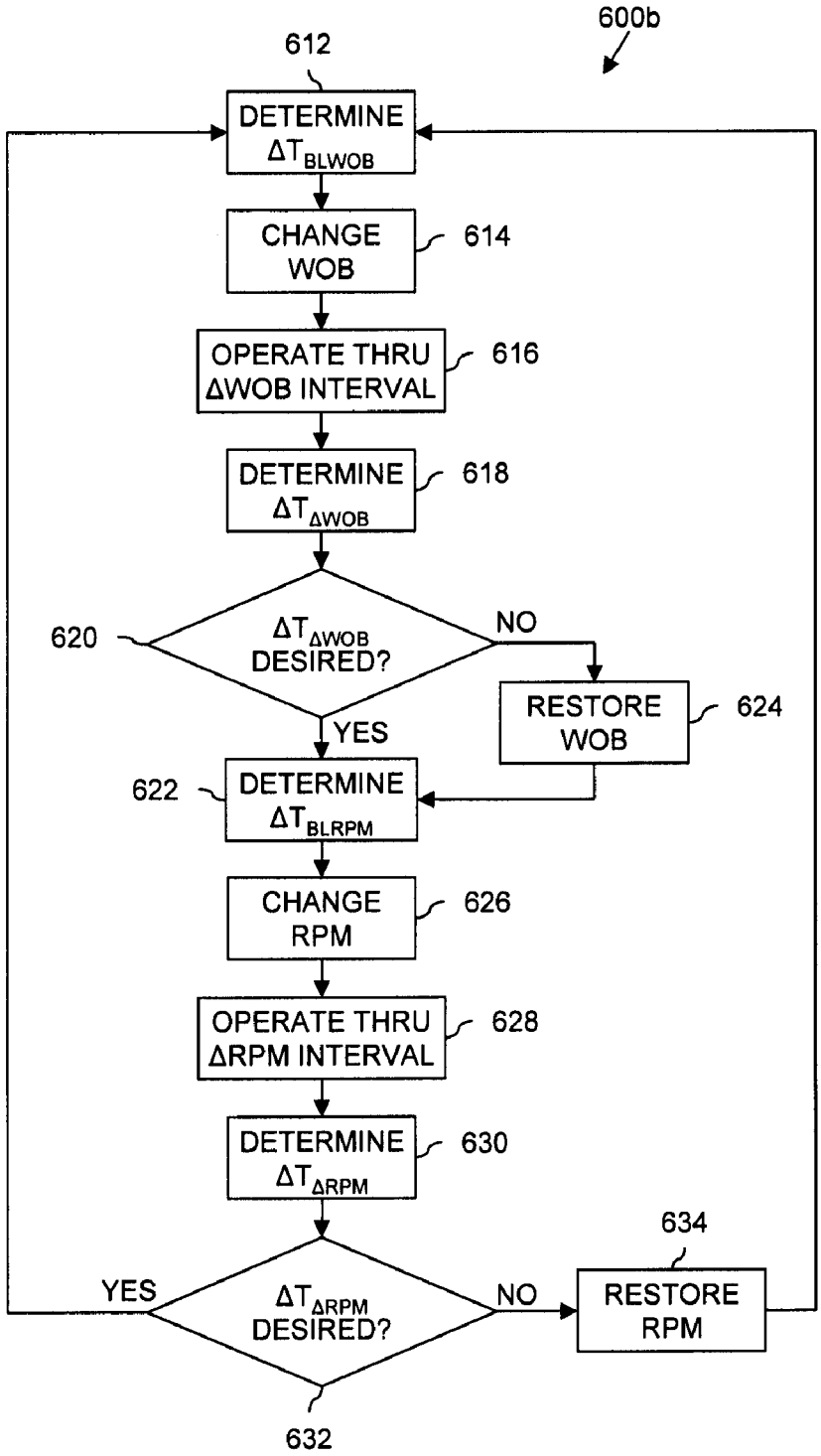
FIG. 6B is a flow-chart diagram of a method according to aspects of the present disclosure.

Referring to FIG. 6B, illustrated is a flow-chart diagram of a method 600*b* for monitoring ΔT and/or SSA according to one or more aspects of the present disclosure. The method 600*b* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B. The method 600*b* may also be performed in conjunction with the performance of the method 200*a* shown in FIG. 2A, the method 200*b* shown in FIG. 2B, the method 500*a* shown in FIG. 5A, the method 500*b* shown in FIG. 5C, the method 500*c* shown in FIG. 5D, and/or the method 600*a* shown in FIG. 6A. The method 600*b* shown in FIG. 6B may comprise or form at least a portion of the method 600*a* shown in FIG. 6A.

During a step 612 of the method 600*b*, a baseline ΔT is determined for optimization based on ΔT by varying WOB. Because the baseline ΔT determined in step 612 will be utilized for optimization by varying WOB, the convention $\Delta T_{BL\text{-}WOB}$ will be used herein.

In a subsequent step 614, the WOB is changed. Such change can include either increasing or decreasing the WOB. The increase or decrease of WOB during step 614 may be within certain, predefined WOB limits. For example, the WOB change may be no greater than about 10%. However, other percentages are also within the scope of the present disclosure, including where such percentages are within or beyond the predefined WOB limits. The WOB may be manually changed via operator input, or the WOB may be automatically changed via signals transmitted by a controller, control system, and/or other component of the drilling rig and associated apparatus. As above, such signals may be via remote control from another location.

Thereafter, during a step 616, drilling continues with the changed WOB during a predetermined drilling interval ΔWOB. The ΔWOB interval may be a predetermined time period, such as five minutes, ten minutes, thirty minutes, or some other duration. Alternatively, the ΔWOB interval may be a predetermined drilling progress depth. For example, step 616 may comprise continuing drilling operation with the changed WOB until the existing wellbore is extended five feet, ten feet, fifty feet, or some other depth. The ΔWOB interval may also include both a time and a depth component. For example, the ΔWOB interval may comprise drilling for at least thirty minutes or until the wellbore is extended ten feet. In another example, the ΔWOB interval may include drilling until the wellbore is extended twenty feet, but no longer than ninety minutes. Of course, the above-described time and depth values for the ΔWOB interval are merely examples, and many other values are also within the scope of the present disclosure.

After continuing drilling operation through the ΔWOB interval with the changed WOB, a step 618 is performed to determine the $\Delta T_{\Delta WOB}$ resulting from operating with the changed WOB during the ΔWOB interval. In a subsequent decisional step 620, the changed $\Delta T_{\Delta WOB}$ is compared to the baseline $\Delta T_{BLWOB}$. If the changed $\Delta T_{\Delta WOB}$ is desirable relative to the $\Delta T_{BLWOB}$, the method 600*b* continues to a step 622. However, if the changed $\Delta T_{\Delta WOB}$ is not desirable relative to the $\Delta T_{BLWOB}$, the method 600*b* continues to a step 624 where the WOB is restored to its value before step 614 was performed, and the method then continues to step 622.

The determination made during decisional step 620 may be performed manually or automatically by a controller, control system, and/or other component of the drilling rig and associated apparatus. The determination may comprise finding the $\Delta T_{\Delta WOB}$ to be desirable if it is substantially equal to and/or less than the $\Delta T_{BLWOB}$. However, additional or alternative factors may also play a role in the determination made during step 620.

During step 622 of the method 600*b*, a baseline ΔT is determined for optimization based on ΔT by varying the bit rotational speed, RPM. Because the baseline ΔT determined in step 622 will be utilized for optimization by varying RPM, the convention $\Delta T_{BLRPM}$ will be used herein.

In a subsequent step 626, the RPM is changed. Such change can include either increasing or decreasing the RPM. The increase or decrease of RPM during step 626 may be within certain, predefined RPM limits. For example, the RPM change may be no greater than about 10%. However, other percentages are also within the scope of the present disclosure, including where such percentages are within or beyond the predefined RPM limits. The RPM may be manually changed via operator input, or the RPM may be automatically changed via signals transmitted by a controller, control system, and/or other component of the drilling rig and associated apparatus.

Thereafter, during a step 628, drilling continues with the changed RPM during a predetermined drilling interval ΔRPM. The ΔRPM interval may be a predetermined time period, such as five minutes, ten minutes, thirty minutes, or some other duration. Alternatively, the ΔRPM interval may be a predetermined drilling progress depth. For example, step 628 may comprise continuing drilling operation with the changed RPM until the existing wellbore is extended five feet, ten feet, fifty feet, or some other depth. The ΔRPM interval may also include both a time and a depth component. For example, the ΔRPM interval may comprise drilling for at least thirty minutes or until the wellbore is extended ten feet. In another example, the ΔRPM interval may include drilling until the wellbore is extended twenty feet, but no longer than ninety minutes. Of course, the above-described time and depth values for the ΔRPM interval are merely examples, and many other values are also within the scope of the present disclosure.

After continuing drilling operation through the ΔRPM interval with the changed RPM, a step 630 is performed to determine the $\Delta T_{\Delta RPM}$ resulting from operating with the changed RPM during the ΔRPM interval. In a subsequent decisional step 632, the changed $\Delta T_{\Delta RPM}$ is compared to the baseline $\Delta T_{BLRPM}$. If the changed $\Delta T_{\Delta RPM}$ is desirable relative to the $\Delta T_{BLRPM}$, the method 600*b* returns to step 612. However, if the changed $\Delta T_{\Delta RPM}$ is not desirable relative to the $\Delta T_{BLRPM}$, the method 600*b* continues to step 634 where the RPM is restored to its value before step 626 was performed, and the method then continues to step 612.

The determination made during decisional step 632 may be performed manually or automatically by a controller, control system, and/or other component of the drilling rig and associated apparatus. The determination may comprise finding the $\Delta T_{\Delta RPM}$ to be desirable if it is substantially equal to and/or less than the $\Delta T_{BLRPM}$. However, additional or alternative factors may also play a role in the determination made during step 632.

Moreover, after steps 632 and/or 634 are performed, the method 600*b* may not immediately return to step 612 for a subsequent iteration. For example, a subsequent iteration of the method 600*b* may be delayed for a predetermined time interval or drilling progress depth. Alternatively, the method 600*b* may end after the performance of steps 632 and/or 634.

Figure 6C:
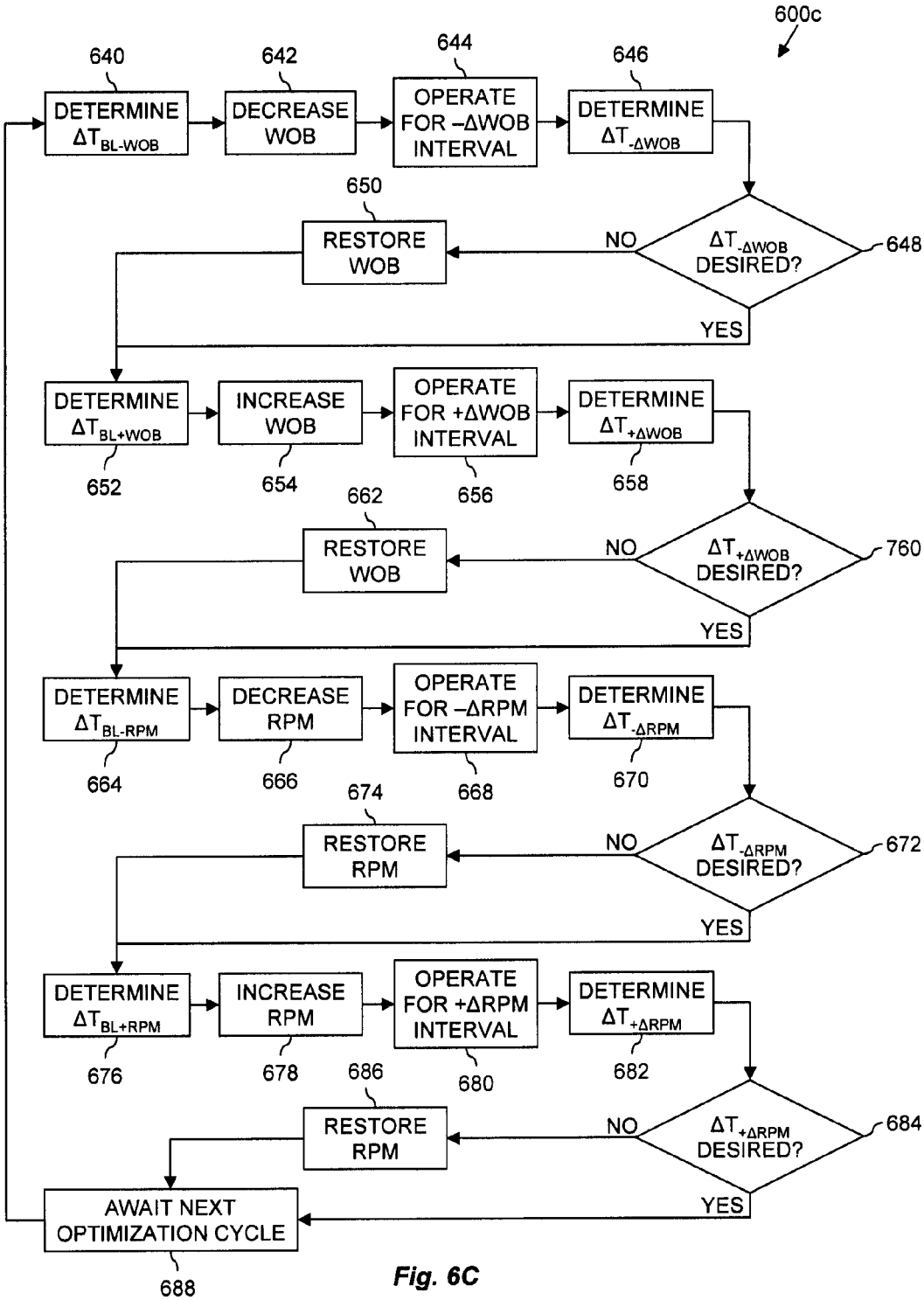
FIG. 6C is a flow-chart diagram of a method according to aspects of the present disclosure.

Referring to FIG. 6C, illustrated is a flow-chart diagram of a method 600*c* for optimizing drilling operation based on real-time calculated ΔT according to one or more aspects of the present disclosure. The method 600*c* may be performed via the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B. The method 600*c* may also be performed in conjunction with the performance of the method 200*a* shown in FIG. 2A, the method 200*b* shown in FIG. 2B, the method 500*a* shown in FIG. 5A, the method 500*b* shown in FIG. 5C, the method 500*c* shown in FIG. 5D, the method 600*a* shown in FIG. 6A, and/or the method 600*b* shown in FIG. 6B. The method 600*c* shown in FIG. 6C may comprise or form at least a portion of the method 600*a* shown in FIG. 6A and/or the method 600*b* shown in FIG. 6B.

During a step 640 of the method 600*c*, a baseline ΔT is determined for optimization based on ΔT by decreasing WOB. Because the baseline ΔT determined in step 640 will be utilized for optimization by decreasing WOB, the convention $\Delta T_{BL-WOB}$ will be used herein.

In a subsequent step 642, the WOB is decreased. The decrease of WOB during step 642 may be within certain, predefined WOB limits. For example, the WOB decrease may be no greater than about 10%. However, other percentages are also within the scope of the present disclosure, including where such percentages are within or beyond the predefined WOB limits. The WOB may be manually decreased via operator input, or the WOB may be automatically decreased via signals transmitted by a controller, control system, and/or other component of the drilling rig and associated apparatus.

Thereafter, during a step 644, drilling continues with the decreased WOB during a predetermined drilling interval −ΔWOB. The −ΔWOB interval may be a predetermined time period, such as five minutes, ten minutes, thirty minutes, or some other duration. Alternatively, the −ΔWOB interval may be a predetermined drilling progress depth. For example, step 644 may comprise continuing drilling operation with the decreased WOB until the existing wellbore is extended five feet, ten feet, fifty feet, or some other depth. The −ΔWOB interval may also include both a time and a depth component. For example, the −ΔWOB interval may comprise drilling for at least thirty minutes or until the wellbore is extended ten feet. In another example, the −ΔWOB interval may include drilling until the wellbore is extended twenty feet, but no longer than ninety minutes. Of course, the above-described time and depth values for the −ΔWOB interval are merely examples, and many other values are also within the scope of the present disclosure.

After continuing drilling operation through the −ΔWOB interval with the decreased WOB, a step 646 is performed to determine the $\Delta T_{BL-\Delta WOB}$ resulting from operating with the decreased WOB during the −ΔWOB interval. In a subsequent decisional step 648, the decreased $\Delta T_{BL-\Delta WOB}$ is compared to the baseline $\Delta T_{BL-WOB}$. If the decreased $\Delta T_{BL-\Delta WOB}$ is desirable relative to the $\Delta T_{BL-WOB}$, the method 600*c* continues to a step 652. However, if the decreased $\Delta T_{BL-\Delta WOB}$ is not desirable relative to the $\Delta T_{BL-WOB}$, the method 600*c* continues to a step 650 where the WOB is restored to its value before step 642 was performed, and the method then continues to step 652.

The determination made during decisional step 648 may be performed manually or automatically by a controller, control system, and/or other component of the drilling rig and associated apparatus. The determination may comprise finding the $\Delta T_{BL-\Delta WOB}$ to be desirable if it is substantially equal to and/or less than the $\Delta T_{BL-WOB}$. However, additional or alternative factors may also play a role in the determination made during step 648.

During step 652 of the method 600*c*, a baseline ΔT is determined for optimization based on ΔT by increasing the WOB. Because the baseline ΔT determined in step 652 will be utilized for optimization by increasing WOB, the convention $\Delta T_{BL+WOB}$ will be used herein.

In a subsequent step 654, the WOB is increased. The increase of WOB during step 654 may be within certain, predefined WOB limits. For example, the WOB increase may be no greater than about 10%. However, other percentages are also within the scope of the present disclosure, including where such percentages are within or beyond the predefined WOB limits. The WOB may be manually increased via operator input, or the WOB may be automatically increased via signals transmitted by a controller, control system, and/or other component of the drilling rig and associated apparatus.

Thereafter, during a step 656, drilling continues with the increased WOB during a predetermined drilling interval +ΔWOB. The +ΔWOB interval may be a predetermined time period, such as five minutes, ten minutes, thirty minutes, or some other duration. Alternatively, the +ΔWOB interval may be a predetermined drilling progress depth. For example, step 656 may comprise continuing drilling operation with the increased WOB until the existing wellbore is extended five feet, ten feet, fifty feet, or some other depth. The +ΔWOB interval may also include both a time and a depth component. For example, the +ΔWOB interval may comprise drilling for at least thirty minutes or until the wellbore is extended ten feet. In another example, the +ΔWOB interval may include drilling until the wellbore is extended twenty feet, but no longer than ninety minutes.

After continuing drilling operation through the +ΔWOB interval with the increased WOB, a step 658 is performed to determine the $\Delta T_{+\Delta WOB}$ resulting from operating with the increased WOB during the +ΔWOB interval. In a subsequent decisional step 660, the changed $\Delta T_{+\Delta WOB}$ is compared to the baseline $\Delta T_{BL+WOB}$. If the changed $\Delta T_{+\Delta WOB}$ is desirable relative to the $\Delta T_{BL+WOB}$, the method 600*c* continues to a step 664. However, if the changed $\Delta T_{+\Delta WOB}$ is not desirable relative to the $\Delta T_{BL+WOB}$, the method 600*c* continues to a step 662 where the WOB is restored to its value before step 654 was performed, and the method then continues to step 664.

The determination made during decisional step 660 may be performed manually or automatically by a controller, control system, and/or other component of the drilling rig and associated apparatus. The determination may comprise finding the $\Delta T_{+\Delta WOB}$ to be desirable if it is substantially equal to and/or less than the $\Delta T_{BL+WOB}$. However, additional or alternative factors may also play a role in the determination made during step 660.

During step 664 of the method 600*c*, a baseline ΔT is determined for optimization based on ΔT by decreasing the bit rotational speed, RPM. Because the baseline ΔT determined in step 664 will be utilized for optimization by decreasing RPM, the convention $\Delta T_{BL-RPM}$ will be used herein.

In a subsequent step 666, the RPM is decreased. The decrease of RPM during step 666 may be within certain, predefined RPM limits. For example, the RPM decrease may be no greater than about 10%. However, other percentages are also within the scope of the present disclosure, including where such percentages are within or beyond the predefined RPM limits. The RPM may be manually decreased via operator input, or the RPM may be automatically decreased via signals transmitted by a controller, control system, and/or other component of the drilling rig and associated apparatus.

Thereafter, during a step 668, drilling continues with the decreased RPM during a predetermined drilling interval −ΔRPM. The −ΔRPM interval may be a predetermined time period, such as five minutes, ten minutes, thirty minutes, or some other duration. Alternatively, the −ΔRPM interval may be a predetermined drilling progress depth. For example, step 668 may comprise continuing drilling operation with the decreased RPM until the existing wellbore is extended five feet, ten feet, fifty feet, or some other depth. The −ΔRPM interval may also include both a time and a depth component. For example, the −ΔRPM interval may comprise drilling for at least thirty minutes or until the wellbore is extended ten feet. In another example, the −ΔRPM interval may include drilling until the wellbore is extended twenty feet, but no longer than ninety minutes.

After continuing drilling operation through the −ΔRPM interval with the decreased RPM, a step 670 is performed to determine the $\Delta T_{-\Delta RPM}$ resulting from operating with the decreased RPM during the −ΔRPM interval. In a subsequent decisional step 672, the decreased $\Delta T_{-\Delta RPM}$ is compared to the baseline $\Delta T_{BL-RPM}$. If the changed $\Delta T_{-\Delta RPM}$ is desirable relative to the $\Delta T_{BL-RPM}$, the method 600*c* continues to a step 676. However, if the changed $\Delta T_{-\Delta RPM}$ is not desirable relative to the $\Delta T_{BL-RPM}$, the method 600*c* continues to a step 674 where the RPM is restored to its value before step 666 was performed, and the method then continues to step 676.

The determination made during decisional step 672 may be performed manually or automatically by a controller, control system, and/or other component of the drilling rig and associated apparatus. The determination may comprise finding the $\Delta T_{-\Delta RPM}$ to be desirable if it is substantially equal to and/or less than the $\Delta T_{BL-RPM}$. However, additional or alternative factors may also play a role in the determination made during step 672.

During step 676 of the method 600*c*, a baseline ΔT is determined for optimization based on ΔT by increasing the bit rotational speed, RPM. Because the baseline ΔT determined in step 676 will be utilized for optimization by increasing RPM, the convention $\Delta T_{BL+RPM}$ will be used herein.

In a subsequent step 678, the RPM is increased. The increase of RPM during step 678 may be within certain, predefined RPM limits. For example, the RPM increase may be no greater than about 10%. However, other percentages are also within the scope of the present disclosure, including where such percentages are within or beyond the predefined RPM limits. The RPM may be manually increased via operator input, or the RPM may be automatically increased via signals transmitted by a controller, control system, and/or other component of the drilling rig and associated apparatus.

Thereafter, during a step 680, drilling continues with the increased RPM during a predetermined drilling interval +ΔRPM. The +ΔRPM interval may be a predetermined time period, such as five minutes, ten minutes, thirty minutes, or some other duration. Alternatively, the +ΔRPM interval may be a predetermined drilling progress depth. For example, step 680 may comprise continuing drilling operation with the increased RPM until the existing wellbore is extended five feet, ten feet, fifty feet, or some other depth. The +ΔRPM interval may also include both a time and a depth component. For example, the +ΔRPM interval may comprise drilling for at least thirty minutes or until the wellbore is extended ten feet. In another example, the +ΔRPM interval may include drilling until the wellbore is extended twenty feet, but no longer than ninety minutes.

After continuing drilling operation through the +ΔRPM interval with the increased RPM, a step 682 is performed to determine the $\Delta T_{+\Delta RPM}$ resulting from operating with the increased RPM during the +ΔRPM interval. In a subsequent decisional step 684, the increased $\Delta T_{+\Delta RPM}$ is compared to the baseline $\Delta T_{BL+RPM}$. If the changed $\Delta T_{+\Delta RPM}$ is desirable relative to the $\Delta T_{BL+RPM}$, the method 600*c* continues to a step 688. However, if the changed $\Delta T_{+\Delta RPM}$ is not desirable relative to the $\Delta T_{BL+RPM}$, the method 600*c* continues to a step 686 where the RPM is restored to its value before step 678 was performed, and the method then continues to step 688.

The determination made during decisional step 684 may be performed manually or automatically by a controller, control system, and/or other component of the drilling rig and associated apparatus. The determination may comprise finding the $\Delta T_{+\Delta RPM}$ to be desirable if it is substantially equal to and/or less than the $\Delta T_{BL+RPM}$. However, additional or alternative factors may also play a role in the determination made during step 684.

Step 688 comprises awaiting a predetermined time period or drilling depth interval before reiterating the method 600*c* by returning to step 640. However, in an exemplary embodiment, the interval may be as small as 0 seconds or 0 feet, such that the method returns to step 640 substantially immediately after performing steps 684 and/or 686. Alternatively, the method 600*c* may not require iteration, such that the method 600*c* may substantially end after the performance of steps 684 and/or 686.

Moreover, the drilling intervals −ΔWOB, +ΔWOB, −ΔRPM and +ΔROM may each be substantially identical within a single iteration of the method 600*c*. Alternatively, one or more of the intervals may vary in duration or depth relative to the other intervals. Similarly, the amount that the WOB is decreased and increased in steps 642 and 654 may be substantially identical or may vary relative to each other within a single iteration of the method 600*c*. The amount that the RPM is decreased and increased in steps 666 and 678 may be substantially identical or may vary relative to each other within a single iteration of the method 600*c*. The WOB and RPM variances may also change or stay the same relative to subsequent iterations of the method 600*c*.

Figure 7:
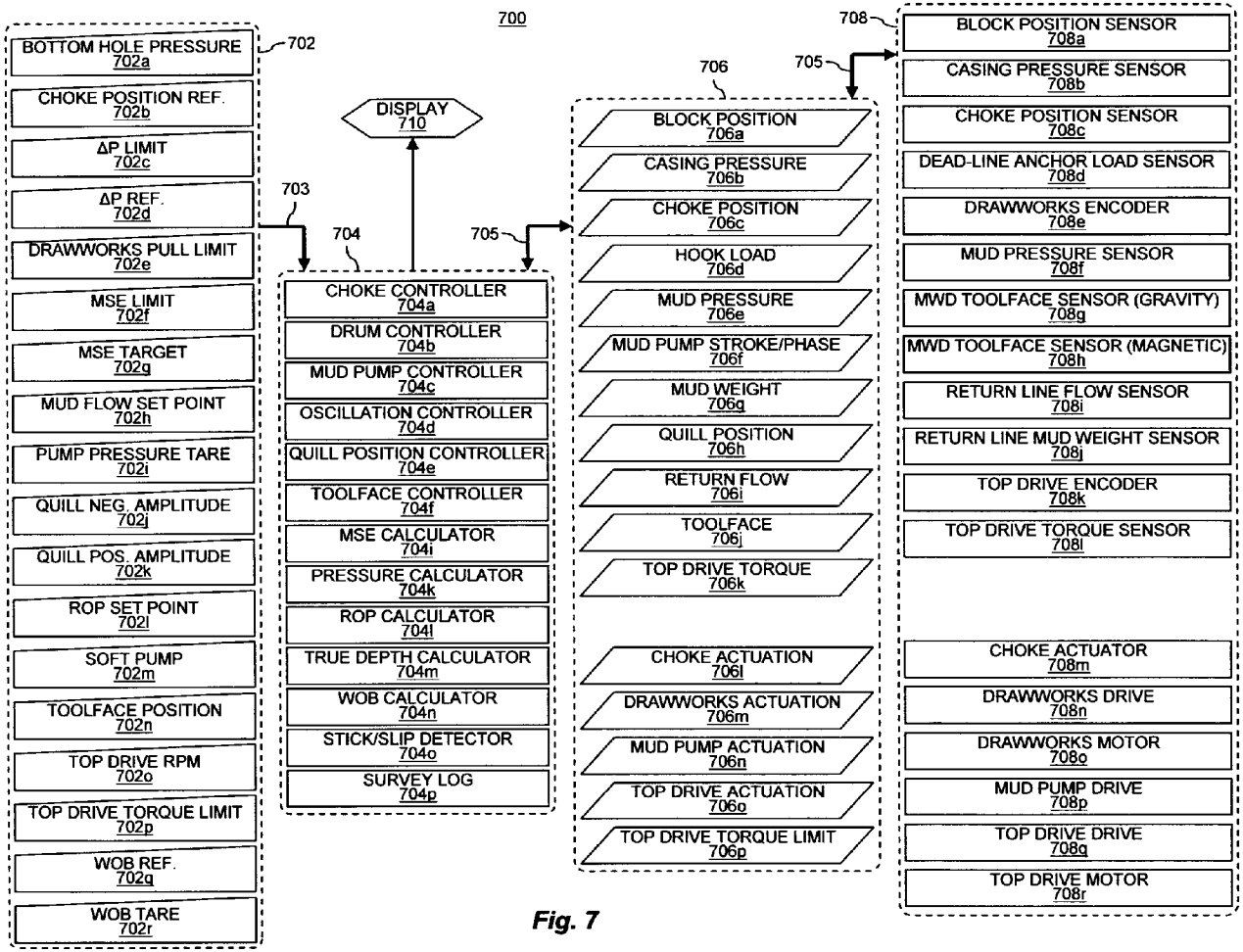
FIG. 7 is a schematic diagram of apparatus according to aspects of the present disclosure.

Referring to FIG. 7, illustrated is a schematic view of apparatus 700 according to one or more aspects of the present disclosure. The apparatus 700 may comprise or compose at least a portion of the apparatus 100 shown in FIG. 1, the apparatus 300 shown in FIG. 3, the apparatus 400*a* shown in FIG. 4A, the apparatus 400*b* shown in FIG. 4B, and/or the apparatus 590 shown in FIG. 5B. The apparatus 700 represents an exemplary embodiment in which one or more methods within the scope of the present disclosure may be performed or otherwise implemented, including the method 200*a* shown in FIG. 2A, the method 200*b* shown in FIG. 2B, the method 500*a* shown in FIG. 5A, the method 500*b* shown in FIG. 5C, the method 500*c* shown in FIG. 5D, the method 600*a* shown in FIG. 6A, the method 600*b* shown in FIG. 6B, and/or the method 600*c* shown in FIG. 6C.

The apparatus 700 includes a plurality of manual or automated data inputs, collectively referred to herein as inputs 702. The apparatus also includes a plurality of controllers, calculators, detectors, and other processors, collectively referred to herein as processors 704. Data from the various ones of the inputs 702 is transmitted to various ones of the processors 704, as indicated in FIG. 7 by the arrow 703. The apparatus 700 also includes a plurality of sensors, encoders, actuators, drives, motors, and other sensing, measurement, and actuation devices, collectively referred to herein as devices 708. Various data and signals, collectively referred to herein as data 706, are transmitted between various ones of the processors 704 and various ones of the devices 708, as indicated in FIG. 7 by the arrows 705.

The apparatus 700 may also include, be connected to, or otherwise be associated with a display 710, which may be driven by or otherwise receive data from one or more of the processors 704, if not also from other components of the apparatus 700. The display 710 may also be referred to herein as a human-machine interface (HMI), although such HMI may further comprise one or more of the inputs 702 and/or processors 704.

In the exemplary embodiment shown in FIG. 7, the inputs 702 include means for providing the following set points, limits, ranges, and other data:

bottom hole pressure 702*a;*
choke position reference 702*b;*
ΔP limit 702*c;*
ΔP reference 702*d;*
drawworks pull limit 702*e;*
MSE limit 702*f;*
MSE target 702*g;*
mud flow set point 702*h;*
pump pressure tare 702*i;*
quill negative amplitude 702*j;*
quill positive amplitude 702*k;*

ROP set point 702*l*;
toolface position 702*n*;
top drive RPM 702*o*;
top drive torque limit 702*p*;
WOB reference 702*q*; and
WOB tare 702*r*.

However, the inputs 702 may include means for providing additional or alternative set points, limits, ranges, and other data within the scope of the present disclosure.

The bottom hole pressure 702*a* may indicate a value of the maximum desired pressure of the gaseous and/or other environment at the bottom end of the wellbore. Alternatively, the bottom hole pressure 702*a* may indicate a range within which it is desired that the pressure at the bottom of the wellbore be maintained. Such pressure may be expressed as an absolute pressure or a gauge pressure (e.g., relative to atmospheric pressure or some other predetermined pressure).

The choke position reference 702*b* may be a set point or value indicating the desired choke position. Alternatively, the choke position reference 702*b* may indicate a range within which it is desired that the choke position be maintained. The choke may be a device having an orifice or other means configured to control fluid flow rate and/or pressure. The choke may be positioned at the end of a choke line, which is a high-pressure pipe leading from an outlet on the BOP stack, whereby the fluid under pressure in the wellbore can flow out of the well through the choke line to the choke, thereby reducing the fluid pressure (e.g., to atmospheric pressure). The choke position reference 702*b* may be a binary indicator expressing the choke position as either "opened" or "closed." Alternatively, the choke position reference 702*b* may be expressed as a percentage indicating the extent to which the choke is partially opened or closed.

The ΔP limit 702*c* may be a value indicating the maximum or minimum pressure drop across the mud motor. Alternatively, the ΔP limit 702*c* may indicate a range within which it is desired that the pressure drop across the mud motor be maintained. The ΔP reference 702*d* may be a set point or value indicating the desired pressure drop across the mud motor. In an exemplary embodiment, the ΔP limit 702*c* is a value indicating the maximum desired pressure drop across the mud motor, and the ΔP reference 702*d* is a value indicating the nominal desired pressure drop across the mud motor.

The drawworks pull limit 702*e* may be a value indicating the maximum force to be applied to the drawworks by the drilling line (e.g., when supporting the drill string off-bottom or pulling on equipment stuck in the wellbore). For example, the drawworks pull limit 702 may indicate the maximum hook load that should be supported by the drawworks during operation. The drawworks pull limit 702*e* may be expressed as the maximum weight or drilling line tension that can be supported by the drawworks without damaging the drawworks, drilling line, and/or other equipment.

The MSE limit 702*f* may be a value indicating the maximum or minimum MSE desired during drilling. Alternatively, the MSE limit 702*f* may be a range within which it is desired that the MSE be maintained during drilling. As discussed above, the actual value of the MSE is at least partially dependent upon WOB, bit diameter, bit speed, drill string torque, and ROP, each of which may be adjusted according to aspects of the present disclosure to maintain the desired MSE. The MSE target 702*g* may be a value indicating the desired MSE, or a range within which it is desired that the MSE be maintained during drilling. In an exemplary embodiment, the MSE limit 702*f* is a value or range indicating the maximum and/or minimum MSE, and the MSE target 702*g* is a value indicating the desired nominal MSE.

The mud flow set point 702*h* may be a value indicating the maximum, minimum, or nominal desired mud flow rate output by the mud pump. Alternatively, the mud flow set point 702*h* may be a range within which it is desired that the mud flow rate be maintained. The pump pressure tare 702*i* may be a value indicating the current, desired, initial, surveyed, or other mud pump pressure tare. The mud pump pressure tare generally accounts for the difference between the mud pressure and the casing or wellbore pressure when the drill string is off bottom.

The quill negative amplitude 702*j* may be a value indicating the maximum desired quill rotation from the quill oscillation neutral point in a first angular direction, whereas the quill positive amplitude 702*k* may be a value indicating the maximum desired quill rotation from the quill oscillation neutral point in an opposite angular direction. For example, during operation of the top drive to oscillate the quill, the quill negative amplitude 702*j* may indicate the maximum desired clockwise rotation of the quill past the oscillation neutral point, and the quill positive amplitude 702*k* may indicate the maximum desired counterclockwise rotation of the quill past the oscillation neutral point.

The ROP set point 702*l* may be a value indicating the maximum, minimum, or nominal desired ROP. Alternatively, the ROP set point 702*l* may be range within which it is desired that the ROP be maintained.

The toolface position 702*n* may be a value indicating the desired orientation of the toolface. Alternatively, the toolface position 702*n* may be a range within which it is desired that the toolface be maintained. The toolface position 702*n* may be expressed as one or more angles relative to a fixed or predetermined reference. For example, the toolface position 702*n* may represent the desired toolface azimuth orientation relative to true North and/or the desired toolface inclination relative to vertical.

The top drive RPM 702*o* may be a value indicating a maximum, minimum, or nominal desired rotational speed of the top drive. Alternatively, the top drive RPM 702*o* may be a range within which it is desired that the top drive rotational speed be maintained. The top drive torque limit 702*p* may be a value indicating a maximum torque to be applied by the top drive.

The WOB reference 702*q* may be a value indicating a maximum, minimum, or nominal desired WOB resulting from the weight of the drill string acting on the drill bit, although perhaps also taking into account other forces affecting WOB, such as friction between the drill string an the wellbore. Alternatively, the WOB reference 702*q* may be a range in which it is desired that the WOB be maintained. The WOB tare 702*r* may be a value indicating the current, desired, initial, survey, or other WOB tare, which takes into account the hook load and drill string weight when off bottom.

One or more of the inputs 702 may include a keypad, voice-recognition apparatus, dial, joystick, mouse, data base and/or other conventional or future-developed data input device. One or more of the inputs 702 may support data input from local and/or remote locations. One or more of the inputs 702 may include means for user-selection of predetermined set points, values, or ranges, such as via one or more drop-down menus. One or more of the inputs 702 may also or alternatively be configured to enable automated input by one or more of the processors 704, such as via the execution of one or more database look-up procedures. One or more of the inputs 702, possibly in conjunction with other components of the apparatus 700, support operation and/or monitoring from stations on the rig site as well as one or more remote locations. Each of the inputs 702 may have individual means for input, although two or more of the inputs 702 may collectively have a single means for input. One or more of the inputs 702 may be configured to allow human input, although one or more of the inputs 702 may alternatively be configured for the automatic input of data by computer, software, module, routine, database lookup, algorithm, calculation, and/or otherwise. One or more of the inputs 702 may be configured for such automatic input of data but with an override function by which a human operator may approve or adjust the automatically provided data.

In the exemplary embodiment shown in FIG. 7A, the devices 708 include:

a block position sensor 708*a;*
a casing pressure sensor 708*b;*
a choke position sensor 708*c;*
a dead-line anchor load sensor 708*d;*
a drawworks encoder 708*e;*
a mud pressure sensor 708*f;*
an MWD toolface gravity sensor 708*g;*
an MWD toolface magnetic sensor 708*h;*
a return line flow sensor 708*i;*
a return line mud weight sensor 708*j;*
a top drive encoder 708*k;*
a top drive torque sensor 708*l;*
a choke actuator 708*m;*
a drawworks drive 708*n;*
a drawworks motor 708*o;*
a mud pump drive 708*p;*
a top drive drive 708*q*; and
a top drive motor 708*r.*

However, the devices 708 may include additional or alternative devices within the scope of the present disclosure. The devices 708 are configured for operation in conjunction with corresponding ones of a drawworks, a choke, a mud pump, a top drive, a block, a drill string, and/or other components of the rig. Alternatively, the devices 708 also include one or more of these other rig components.

The block position sensor 708*a* may be or include an optical sensor, a radio-frequency sensor, an optical or other encoder, or another type of sensor configured to sense the relative or absolute vertical position of the block. The block position sensor 708*a* may be coupled to or integral with the block, the crown, the drawworks, and/or another component of the apparatus 700 or rig.

The casing pressure sensor 708*b* is configured to detect the pressure in the annulus defined between the drill string and the casing or wellbore, and may be or include one or more transducers, strain gauges, and/or other devices for detecting pressure changes or otherwise sensing pressure. The casing pressure sensor 708*b* may be coupled to the casing, drill string, and/or another component of the apparatus 700 or rig, and may be positioned at or near the wellbore surface, slightly below the surface, or significantly deeper in the wellbore.

The choke position sensor 708*c* is configured to detect whether the choke is opened or closed, and may be further configured to detect the degree to which the choke is partially opened or closed. The choke position sensor 708*c* may be coupled to or integral with the choke, the choke actuator, and/or another component of the apparatus 700 or rig.

The dead-line anchor load sensor 708*d* is configured to detect the tension in the drilling line at or near the anchored end. It may comprise one or more transducers, strain gauges, and/or other sensors coupled to the drilling line.

The drawworks encoder 708*e* is configured to detect the rotational position of the drawworks spools around which the drilling line is wound. It may comprise one or more optical encoders, interferometers, and/or other sensors configured to detect the angular position of the spool and/or any change in the angular position of the spool. The drawworks encoder 708*e* may include one or more components coupled to or integral with the spool and/or a stationary portion of the drawworks.

The mud pressure sensor 708*f* is configured to detect the pressure of the hydraulic fluid output by the mud motor, and may be or include one or more transducers, strain gauges, and/or other devices for detecting fluid pressure. It may be coupled to or integral with the mud pump, and thus positioned at or near the surface opening of the wellbore.

The MWD toolface gravity sensor 708*g* is configured to detect the toolface orientation based on gravity. The MWD toolface magnetic sensor 708*h* is configured to detect the toolface orientation based on magnetic field. These sensors 708*g* and 708*h* may be coupled to or integral with the MWD assembly, and are thus positioned downhole.

The return line flow sensor 708*i* is configured to detect the flow rate of mud within the return line, and may be expressed in gallons/minute. The return line mud weight sensor 708*j* is configured to detect the weight of the mud flowing within the return line. These sensors 708*i* and 708*j* may be coupled to the return flow line, and may thus be positioned at or near the surface opening of the wellbore.

The top drive encoder 708*k* is configured to detect the rotational position of the quill. It may comprise one or more optical encoders, interferometers, and/or other sensors configured to detect the angular position of the quill, and/or any change in the angular position of the quill, relative to the top drive, true North, or some other fixed reference point. The top drive torque sensor 708*l* is configured to detect the torque being applied by the top drive, or the torque necessary to rotate the quill or drill string at the current rate. These sensors 708*k* and 708*l* may be coupled to or integral with the top drive.

The choke actuator 708*m* is configured to actuate the choke to configure the choke in an opened configuration, a closed configured, and/or one or more positions between fully opened and fully closed. It may be hydraulic, pneumatic, mechanical, electrical, or combinations thereof.

The drawworks drive 708*n* is configured to provide an electrical signal to the drawworks motor 708*o* for actuation thereof. The drawworks motor 708*o* is configured to rotate the spool around which the drilling line is wound, thereby feeding the drilling line in or out.

The mud pump drive 708*p* is configured to provide an electrical signal to the mud pump, thereby controlling the flow rate and/or pressure of the mud pump output. The top drive drive 708*q* is configured to provide an electrical signal to the top drive motor 708*r* for actuation thereof. The top drive motor 708*r* is configured to rotate the quill, thereby rotating the drill string coupled to the quill.

In the exemplary embodiment shown in FIG. 7, the data 706 which is transmitted between the devices 708 and the processors 704 includes:

block position 706*a;*
casing pressure 706*b;*
choke position 706*c;*
hook load 706*d;*
mud pressure 706*e;*
mud pump stroke/phase 706*f;*
mud weight 706*g;*
quill position 706*h;*
return flow 706*i;*
toolface 706*j;*
top drive torque 706*k;*
choke actuation signal 706*l;*
drawworks actuation signal 706*m;* mud pump actuation signal 706*n;*
top drive actuation signal 706*o*; and
top drive torque limit signal 706*p.*

However, the data 706 transferred between the devices 708 and the processors 704 may include additional or alternative data within the scope of the present disclosure.

In the exemplary embodiment shown in FIG. 7, the processors 704 include:

a choke controller 704*a;*
a drum controller 704*b;*
a mud pump controller 704*c;*
an oscillation controller 704*d;*
a quill position controller 704*e;*
a toolface controller 704*f;*
an MSE calculator 704*i;*
a pressure calculator 704*k;*
an ROP calculator 704*l;*
a true depth calculator 704*m;*
a WOB calculator 704*n;*
a stick/slip detector 704*o*; and
a survey log 704*p.*

However, the processors 704 may include additional or alternative controllers, calculators, detectors, data storage, and/or other processors within the scope of the present disclosure.

The choke controller 704*a* is configured to receive the bottom hole pressure setting from the bottom hole pressure input 702*a*, the casing pressure 706*b* from the casing pressure sensor 708*b*, the choke position 706*c* from the choke position sensor 708*c*, and the mud weight 706*g* from the return line mud weight sensor 708*j*. The choke controller 704*a* may also receive bottom hole pressure data from the pressure calculator 704*k*. Alternatively, the processors 704 may include a comparator, summing, or other device which performs an algorithm utilizing the bottom hole pressure setting received from the bottom hole pressure input 702*a* and the current bottom hole pressure received from the pressure calculator 704*k*, with the result of such algorithm being provided to the choke controller 704*a* in lieu of or in addition to the bottom hole pressure setting and/or the current bottom hole pressure. The choke controller 704*a* is configured to process the received data and generate the choke actuation signal 706*l*, which is then transmitted to the choke actuator 708.

For example, if the current bottom hole pressure is greater than the bottom hole pressure setting, then the choke actuation signal 706*l* may direct the choke actuator 708*m* to further open, thereby increasing the return flow rate and decreasing the current bottom hole pressure. Similarly, if the current bottom hole pressure is less than the bottom hole pressure setting, then the choke actuation signal 706*l* may direct the choke actuator 708*m* to further close, thereby decreasing the return flow rate and increasing the current bottom hole pressure. Actuation of the choke actuator 708*m* may be incremental, such that the choke actuation signal 706*l* repeatedly directs the choke actuator 708*m* to further open or close by a predetermined amount until the current bottom hole pressure satisfactorily complies with the bottom hole pressure setting. Alternatively, the choke actuation signal 706*l* may direct the choke actuator 708*m* to further open or close by an amount proportional to the current discord between the current bottom hole pressure and the bottom hole pressure setting.

The choke controller 704*a* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The drum controller 704*b* is configured to receive the ROP set point from the ROP set point input 702*l*, as well as the current ROP from the ROP calculator 704*l*. The drum controller 704*b* is also configured to receive WOB data from a comparator, summing, or other device which performs an algorithm utilizing the WOB reference point from the WOB reference input 702*g* and the current WOB from the WOB calculator 704*n*. This WOB data may be modified based current MSE data. Alternatively, the drum controller 704*b* is configured to receive the WOB reference point from the WOB reference input 702*g* and the current WOB from the WOB calculator 704*n* directly, and then perform the WOB comparison or summing algorithm itself. The drum controller 704*b* is also configured to receive ΔP data from a comparator, summing, or other device which performs an algorithm utilizing the ΔP reference received from the ΔP reference input 702*d* and a current ΔP received from one of the processors 704 that is configured to determine the current ΔP. The current ΔP may be corrected to take account the casing pressure 706*b*.

The drum controller 704*b* is configured to process the received data and generate the drawworks actuation signal 706*m*, which is then transmitted to the drawworks drive 708*n*. For example, if the current WOB received from the WOB calculator 704*n* is less than the WOB reference point received from the WOB reference input 702*q*, then the drawworks actuation signal 706*m* may direct the drawworks drive 708*n* to cause the drawworks motor 708*o* to feed out more drilling line. If the current WOB is less than the WOB reference point, then the drawworks actuation signal 706*m* may direct the drawworks drive 708*n* to cause the drawworks motor 708*o* to feed in the drilling line.

If the current ROP received from the ROP calculator 704*l* is less than the ROP set point received from the ROP set point input 702*l*, then the drawworks actuation signal 706*m* may direct the drawworks drive 708*n* to cause the drawworks motor 708*o* to feed out more drilling line. If the current ROP is greater than the ROP set point, then the drawworks actuation signal 706*m* may direct the drawworks drive 708*n* to cause the drawworks motor 708*o* to feed in the drilling line.

If the current ΔP is less than the ΔP reference received from the ΔP reference input 702*d*, then the drawworks actuation signal 706*m* may direct the drawworks drive 708*n* to cause the drawworks motor 708*o* to feed out more drilling line. If the current ΔP is greater than the ΔP reference, then the drawworks actuation signal 706*m* may direct the drawworks drive 708*n* to cause the drawworks motor 708*o* to feed in the drilling line.

The drum controller 704*b* may comprise or compose at least a portion of, or otherwise be substantially similar in operation, and/or have substantially similar data inputs and outputs, relative to the controller 190 shown in FIG. 1, the controller 325 shown in FIG. 3, the drawworks controller 420*b* shown in FIGS. 4A and 4B, and/or the controller 598 shown in FIG. 5B.

The mud pump controller 704*c* is configured to receive the mud pump stroke/phase data 706*f*, the mud pressure 706*e* from the mud pressure sensor 708*f*, the current ΔP, the current MSE from the MSE calculator 704*i*, the current ROP from the ROP calculator 704*l*, a stick/slip indicator from the stick/slip detector 704*o*, and the mud flow rate set point from the mud flow set point input 702*h*. The mud pump controller 704*c* then utilizes this data to generate the mud pump actuation signal 706*n*, which is then transmitted to the mud pump 708*p*.

The mud pump controller 704*c* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIG. 4A, the mud pump controller 420*c* shown in FIG. 4B, and/or the controller 598 shown in FIG. 5B.

The oscillation controller 704*d* is configured to receive the current quill position 706*h*, the current top drive torque 706*k*, the stick/slip indicator from the stick/slip detector 704*o*, the current ROP from the ROP calculator 704*l*, and the quill oscillation amplitude limits from the inputs 702*j* and 702*k*. The oscillation controller 704*d* then utilizes this data to generate an input to the quill position controller 704*e* for use in generating the top drive actuation signal 706*o*. For example, if the stick/slip indicator from the stick/slip detector 704*o* indicates that stick/slip is occurring, then the signal generated by the oscillation controller 704*d* may indicate that oscillation needs to commence or increase in amplitude.

The oscillation controller 704*d* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The quill position controller 704*e* is configured to receive the signal from the oscillation controller 704*d*, the top drive RPM setting from the top drive RPM input 702*o*, a signal from the toolface controller 704*f*, the current WOB from the WOB calculator 704*n*, and the current toolface 706*j* from at least one of the MWD toolface sensors 708*g* and 708*h*. The quill position controller 704*e* may also be configured to receive the top drive torque limit setting from the top drive torque limit input 702*p*, although this setting may be adjusted by a comparator, summing, or other device to account for the current MSE, where the current MSE is received from the MSE calculator 704*i*. The quill position controller 704*e* may also be configured to receive a stick/slip indicator from the stick/slip detector 704*o*. The quill position controller 704*e* then utilizes this data to generate the top drive actuation signal 706*o*.

For example, the top drive actuation signal 706*o* causes the top drive drive 708*q* to cause the top drive motor 708*r* to rotate the quill at the speed indicated by top drive RPM input 702*o*. However, this may only occur when other inputs aren't overriding this objective. For example, if so directed by the signal from the oscillation controller 704*d*, the top drive actuation signal 706*o* will also cause the top drive drive 708*q* to cause the top drive motor 708*r* to rotationally oscillate the quill. Additionally, the signal from the toolface controller 704*d* may override or otherwise influence the top drive actuation signal 706*o* to rotationally orient the quill at a certain static position or set a neutral point for oscillation.

The quill position controller 704*e* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The toolface controller 704*f* is configured to receive the toolface position setting from the toolface position input 702*n*, as well as the current toolface 706*j* from at least one of the MWD toolface sensors 708*g* and 708*h*. The toolface controller 704*f* may also be configured to receive ΔP data. The toolface controller 704*f* then utilizes this data to generate a signal which is provided to the quill position controller 704*e*.

The toolface controller 704*f* may comprise or compose at least a portion of, or otherwise be substantially similar in operation, and/or have substantially similar data inputs and outputs, relative to the controller 190 shown in FIG. 1, the controller 325 shown in FIG. 3, the toolface controller 420*a* shown in FIGS. 4A and 4B, and/or the controller 598 shown in FIG. 5B.

The MSE calculator 704*i* is configured to receive current RPM data from the top drive RPM input 702*o*, the top drive torque 706*k* from the top drive torque sensor 708*l*, and the current WOB from the WOB calculator 704*n*. The MSE calculator 704*i* then utilizes this data to calculate the current MSE, which is then transmitted to the drum controller 704*b*, the quill position controller 704*e*, and the mud pump controller 704*c*. The MSE calculator 704*i* may also be configured to receive the MSE limit setting from the MSE limit input 702*f*, in which case the MSE calculator 704*i* may also be configured to compare the current MSE to the MSE limit setting and trigger an alert if the current MSE exceeds the MSE limit setting. The MSE calculator 704*i* may also be configured to receive the MSE target setting from the MSE target input 702*g*, in which case the MSE calculator 704*i* may also be configured to generate a signal indicating the difference between the current MSE and the MSE target. This signal may be utilized by one or more of the processors 704 to correct adjust various data values utilized thereby, such as the adjustment to the current or reference WOB utilized by the drum controller 704*b*, and/or the top drive torque limit setting utilized by the quill position controller 704*e*, as described above.

The MSE calculator 704*i* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The pressure calculator 704*k* is configured to receive the casing pressure 706*b* from the casing pressure sensor 708*b*, the mud pressure 706*e* from the mud pressure sensor 708*f*, the mud weight 706*g* from the return line mud weight sensor 708*j*, and the true vertical depth from the true depth calculator 704*m*. The pressure calculator 704*k* then utilizes this data to calculate the current bottom hole pressure, which is then transmitted to choke controller 704*a*. However, before being sent to the choke controller 704*a*, the current bottom hole pressure may be compared to the bottom hole pressure setting received from the bottom hole pressure input 702*a*, in which case the choke controller 704*a* may utilize only the difference between the current bottom home pressure and the bottom hole pressure setting when generating the choke actuation signal 706*l*. This comparison between the current bottom hole pressure and the bottom hole pressure setting may be performed by the pressure calculator 704*k*, the choke controller 704*a*, or another one of the processors 704.

The pressure calculator 704*k* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The ROP calculator 704*l* is configured to receive the block position 706*a* from the block position 708*a* and then utilize this data to calculate the current ROP. The current ROP is then transmitted to the true depth calculator 704*m*, the drum controller 704*b*, the mud pump controller 704*c*, and the oscillation controller 704*d*. The ROP calculator 704*l* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The true depth calculator 704*m* is configured to receive the current toolface 706*j* from at least one of the MWD toolface sensors 708*g* and 708*h*, the survey log 704*p*, and the current measured depth that is calculated from the current ROP received from the ROP calculator 704*l*. The true depth calculator 704*m* then utilizes this data to calculate the true vertical depth, which is then transmitted to the pressure calculator 704*k*. The true depth calculator 704*m* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The WOB calculator 704*n* is configured to receive the stick/slip indicator from the stick/slip detector 704*o*, as well as the current hook load 706*d* from the dead-line anchor load sensor 708*d*. The WOB calculator 704*n* may also be configured to receive an off-bottom string weight tare, which may be the difference between the WOB tare received from the WOB tare input 702*r* and the current hook load 706*d* received from the dead-line anchor load sensor 708*d*. In any case, the WOB calculator 704*n* is configured to calculate the current WOB based on the current hook load, the current string weight, and the stick-slip indicator. The current WOB is then transmitted to the quill position controller 704*e*, the d-exponent calculator 704*g*, the d-exponent-corrected calculator 704*h*, the MSE calculator 704*i*, and the drum controller 704*b*.

The WOB calculator 704*n* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The stick/slip detector 704*o* is configured to receive the current top drive torque 706*k* and utilize this data to generate the stick/slip indicator, which is then provided to the mud pump controller 704*c*, the oscillation controller 704*d*, and the quill position controller 704*e*. The stick/slip detector 704*o* measures changes in the top drive torque 706*k* relative to time, which is indicative of whether the bit may be exhibiting stick/slip behavior, indicating that the top drive torque and/or WOB should be reduced or the quill oscillation amplitude should be modified. The stick/slip detector 704*o* may comprise or compose at least a portion of, or otherwise be substantially similar in operation, and/or have substantially similar data inputs and outputs, relative to the controller 190 shown in FIG. 1, the controller 325 shown in FIG. 3, the controller 420 shown in FIGS. 4A and 4B, and/or the controller 598 shown in FIG. 5B.

The processors 704 may be collectively implemented as a single processing device, or as a plurality of processing devices. Each processor 704 may include one or more software or other program product modules, sub-modules, routines, sub-routines, state machines, algorithms. Each processor 704 may additional include one or more computer memories or other means for digital data storage. Aspects of one or more of the processors 704 may be substantially similar to those described herein with reference to any controller or other data processing apparatus.

Figure 8:
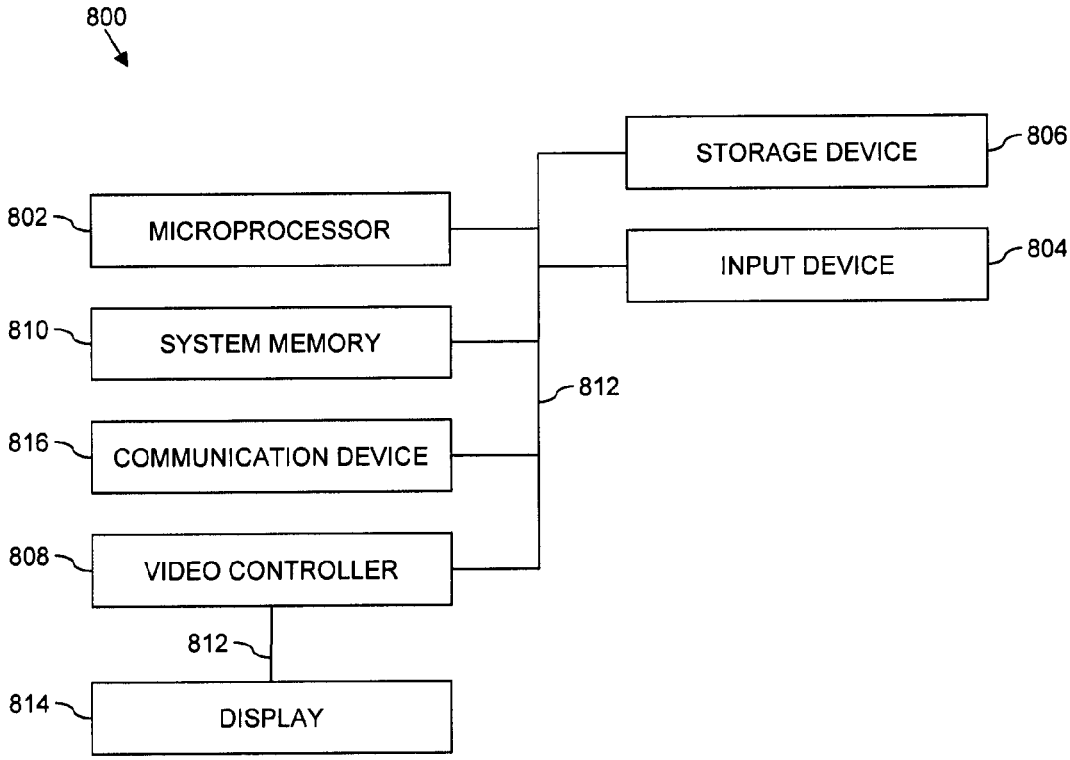
FIG. 8 is a schematic diagram of apparatus according to aspects of the present disclosure.

Referring to FIG. 8, illustrated is an exemplary system 800 for implementing one or more embodiments of at least portions of the apparatus and/or methods described above or otherwise within the scope of the present disclosure. The system 800 includes a processor 802, an input device 804, a storage device 806, a video controller 808, a system memory 810, a display 814, and a communication device 816, all interconnected by one or more buses 812. The storage device 806 may be a floppy drive, hard drive, CD, DVD, optical drive, or any other form of storage device. In addition, the storage device 806 may be capable of receiving a floppy disk, CD, DVD, or any other form of computer-readable medium that may contain computer-executable instructions. Communication device 816 may be a modem, network card, or any other device to enable the system 800 to communicate with other systems, whether such communication is via wired or wireless transmission.

A computer system typically includes at least hardware capable of executing machine readable instructions, as well as software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, PDAs, and personal computing devices (PCDs), for example). Furthermore, hardware typically includes any physical device that is capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

In view of all of the above and FIGS. 1-7, those skilled in the art should readily recognize that the present disclosure introduces methods and apparatus for MSE-based operation and/or optimization. For example, one exemplary method comprises detecting MSE parameters, utilizing the MSE parameters to calculate MSE, and adjusting operational parameters as a function of the calculated MSE.

Another exemplary method within the scope of the present disclosure comprises determining a baseline MSE, changing the WOB, operating through a time or depth interval, determining an updated MSE resulting from operating through the interval using the changed WOB, and then either maintaining the changed WOB or restoring the previous WOB as a function of the updated MSE. Such method may further comprise determining another baseline MSE, changing the RPM, operating through a time or depth interval, determining an updated MSE resulting from operating through the interval using the changed RPM, and then either maintaining the changed RPM or restoring the previous RPM as a function of the updated MSE.

Another exemplary method within the scope of the present disclosure comprises determining a baseline MSE, decreasing the WOB, operating through a time or depth interval, determining an updated MSE resulting from operating through the interval using the decreased WOB, and then either maintaining the decreased WOB or restoring the previous WOB as a function of the updated MSE. Such method may further comprise determining another baseline MSE, increasing the WOB, operating through a time or depth interval, determining an updated MSE resulting from operating through the interval using the increased WOB, and then either maintaining the increased WOB or restoring the previous WOB as a function of the updated MSE. The method may further comprise determining another baseline MSE, decreasing the RPM, operating through a time or depth interval, determining an updated MSE resulting from operating through the interval using the decreased RPM, and then either maintaining the decreased RPM or restoring the previous RPM as a function of the updated MSE. The method may further comprise determining another baseline MSE, increasing the RPM, operating through a time or depth interval, determining an updated MSE resulting from operating through the interval using the increased RPM, and then either maintaining the increased RPM or restoring the previous RPM as a function of the updated MSE.

The present disclosure also introduces an apparatus or system for MSE-based operation and/or optimization comprising means for detecting MSE parameters, means for utilizing the detected MSE parameters to calculate MSE, and means for adjusting operational parameters as a function of the calculated MSE.

Another exemplary apparatus or system within the scope of the present disclosure comprises means for determining a baseline MSE, means for changing the WOB, means for operating through a time or depth interval, means for determining an updated MSE resulting from operating through the interval using the changed WOB, and means for either maintaining the changed WOB or restoring the previous WOB as a function of the updated MSE. Such apparatus or system may further comprise means for determining another baseline MSE, means for changing the RPM, means for operating through a time or depth interval, means for determining an updated MSE resulting from operating through the interval using the changed RPM, and means for either maintaining the changed RPM or restoring the previous RPM as a function of the updated MSE.

Another exemplary apparatus or system within the scope of the present disclosure comprises means for determining a baseline MSE, means for decreasing the WOB, means for operating through a time or depth interval, means for determining an updated MSE resulting from operating through the interval using the decreased WOB, and means for either maintaining the decreased WOB or restoring the previous WOB as a function of the updated MSE. Such apparatus or system may further comprise means for determining another baseline MSE, means for increasing the WOB, means for operating through a time or depth interval, means for determining an updated MSE resulting from operating through the interval using the increased WOB, and means for either maintaining the increased WOB or restoring the previous WOB as a function of the updated MSE. The apparatus or system may further comprise means for determining another baseline MSE, means for decreasing the RPM, means for operating through a time or depth interval, means for determining an updated MSE resulting from operating through the interval using the decreased RPM, and means for either maintaining the decreased RPM or restoring the previous RPM as a function of the updated MSE. The apparatus or system may further comprise means for determining another baseline MSE, means for increasing the RPM, means for operating through a time or depth interval, means for determining an updated MSE resulting from operating through the interval using the increased RPM, and means for either maintaining the increased RPM or restoring the previous RPM as a function of the updated MSE.

One or more of the exemplary apparatus or systems described above may comprise the apparatus 100 shown in FIG. 1, the apparatus 300 shown in FIG. 3, the apparatus **400*a* shown in FIG. 4A, the apparatus 400*b* shown in FIG. 4B, the apparatus 590 shown in FIG. 5B, the apparatus 700 shown in FIG. 7**, and/or components thereof. One or more of the exemplary apparatus or system described above may further be implemented as a software program product. For example, an exemplary embodiment of such program product may comprise a computer readable medium and means recorded on the computer readable medium for: detecting MSE parameters, utilizing the MSE parameters to calculate MSE, and adjusting operational parameters as a function of the calculated MSE.

Another exemplary program product within the scope of the present disclosure comprises a computer readable medium and means recorded on the computer readable medium for: determining a baseline MSE, changing the WOB, operating through a time or depth interval, determining an updated MSE resulting from operating through the interval using the changed WOB, and then either maintaining the changed WOB or restoring the previous WOB as a function of the updated MSE. Such program product may further comprise means recorded on the computer readable medium for: determining another baseline MSE, changing the RPM, operating through a time or depth interval, determining an updated MSE resulting from operating through the interval using the changed RPM, and then either maintaining the changed RPM or restoring the previous RPM as a function of the updated MSE.

Another exemplary program product within the scope of the present disclosure comprises a computer readable medium and means recorded on the computer readable medium for: determining a baseline MSE, decreasing the WOB, operating through a time or depth interval, determining an updated MSE resulting from operating through the interval using the decreased WOB, and then either maintaining the decreased WOB or restoring the previous WOB as a function of the updated MSE. Such program product may further comprise means recorded on the computer readable medium for: determining another baseline MSE, increasing the WOB, operating through a time or depth interval, determining an updated MSE resulting from operating through the interval using the increased WOB, and then either maintaining the increased WOB or restoring the previous WOB as a function of the updated MSE. The program product may further comprise means recorded on the computer readable medium for: determining another baseline MSE, decreasing the RPM, operating through a time or depth interval, determining an updated MSE resulting from operating through the interval using the decreased RPM, and then either maintaining the decreased RPM or restoring the previous RPM as a function of the updated MSE. The program product may further comprise means recorded on the computer readable medium for: determining another baseline MSE, increasing the RPM, operating through a time or depth interval, determining an updated MSE resulting from operating through the interval using the increased RPM, and then either maintaining the increased RPM or restoring the previous RPM as a function of the updated MSE.

Moreover, methods within the scope of the present disclosure may be local or remote in nature. For example, such methods may be deployed or performed via PLC, PAC, PC, one or more servers, desktops, handhelds, and/or any other form or type of computing device with appropriate capability.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method for mechanical specific energy (MSE)-based drilling operation, comprising:

drilling through a first interval utilizing a first weight-on-bit (WOB);

determining automatically a first MSE corresponding to drilling utilizing the first WOB;

drilling through a second interval utilizing a second WOB that is different than the first WOB;

determining automatically a second MSE corresponding to drilling utilizing the second WOB; and drilling through a third interval utilizing one of the first WOB and the second WOB which is automatically selected based on an automated comparison of the first MSE and the second MSE.

2. The method of claim 1 further comprising:

drilling through a fourth interval utilizing a first rotary drive revolutions-per-minute (RD- RPM);

determining automatically a third MSE corresponding to drilling utilizing the first RD- RPM;

drilling through a fifth interval utilizing a second RD-RPM that is different than the first RD-RPM;

determining automatically a fourth MSE corresponding to drilling utilizing the second RD-RPM; and drilling through a sixth interval utilizing one of the first RD-RPM and the second RD-RPM which is automatically selected based on an automated comparison of the third MSE and the fourth MSE.

3. The method of claim 1 wherein the second WOB is less than the first WOB, and wherein the method further comprises:

drilling through a fourth interval utilizing the automatically selected one of the first WOB and the second WOB;

determining automatically a third MSE corresponding to drilling through the fourth interval utilizing the automatically selected one of the first WOB and the second WOB;

drilling through a fifth interval utilizing a third WOB that is greater than the first WOB;

determining automatically a fourth MSE corresponding to drilling through the fifth interval utilizing the third WOB; and drilling through a sixth interval utilizing one of the third WOB and the automatically selected one of the first WOB and the second WOB which is automatically selected based on an automated comparison of the third MSE and the fourth MSE.

4. The method of claim 3 further comprising:

drilling through a seventh interval utilizing a rotary drive first revolutions-per-minute (RD-RPM);

determining automatically a fifth MSE corresponding to drilling utilizing the first RD-RPM;

drilling through an eighth interval utilizing a second RD-RPM that is less than the first RD-RPM;

determining automatically a sixth MSE corresponding to drilling utilizing the second RD-RPM;

drilling through a ninth interval utilizing one of the first RD-RPM and the second RD-RPM which is automatically selected based on an automated comparison of the fifth MSE and the sixth MSE;

drilling through a tenth interval utilizing the automatically selected one of the first RD-RPM and the second RD-RPM;

determining automatically a seventh MSE corresponding to drilling through the tenth interval utilizing the automatically selected one of the first RD-RPM and the second RD-RPM;

drilling through an eleventh interval utilizing a third RD-RPM that is greater than the first RD-RPM;

determining automatically an eighth MSE corresponding to drilling through the eleventh interval utilizing the third RD-RPM; and drilling through a twelfth interval utilizing one of the third RD-RPM and the automatically selected one of the first RD-RPM and the second RD-RPM which is automatically selected based on an automated comparison of the seventh MSE and the eighth MSE.

5. An apparatus for mechanical specific energy (MSE)-based drilling operation, comprising:

means for controlling drilling through a first interval utilizing a first weight-on-bit (WOB);

means for automatically determining a first MSE corresponding to drilling through the first interval utilizing the first WOB;

means for controlling drilling through a second interval utilizing a second WOB that is different than the first WOB;

means for automatically determining a second MSE corresponding to drilling through the second interval utilizing the second WOB;

means for automatically comparing the first MSE and the second MSE and automatically selecting one of the first WOB and the second WOB as a function of the automated comparison of the first MSE and the second MSE; and means for controlling drilling through a third interval utilizing the automatically selected one of the first WOB and the second WOB.

6. The apparatus of claim 5 further comprising:

means for controlling drilling through a fourth interval utilizing a first rotary drive revolutions-per-minute (RD-RPM);

means for automatically determining a third MSE corresponding to drilling utilizing the first RD-RPM;

means for controlling drilling through a fifth interval utilizing a second RD-RPM that is different than the first RD-RPM;

means for automatically determining a fourth MSE corresponding to drilling utilizing the second RD-RPM;

means for automatically comparing the third MSE and the fourth MSE and automatically selecting one of the first RD-RPM and the second RD-RPM as a function of the automated comparison of the third MSE and the fourth MSE; and means for controlling drilling through a sixth interval utilizing the automatically selected one of the first RD-RPM and the second RD-RPM.

7. The apparatus of claim 5 wherein the second WOB is less than the first WOB, and wherein the apparatus further comprises:

means for controlling drilling through a fourth interval utilizing the automatically selected one of the first WOB and the second WOB;

means for automatically determining a third MSE corresponding to drilling through the fourth interval utilizing the automatically selected one of the first WOB and the second WOB;

means for controlling drilling through a fifth interval utilizing a third WOB that is greater than the first WOB;

means for automatically determining a fourth MSE corresponding to drilling through the fifth interval utilizing the third WOB;

means for automatically comparing the third MSE and the fourth MSE and automatically selecting one of the third WOB and the automatically selected one of the first WOB and the second WOB as a function of the automated comparison of the third MSE and the fourth MSE;

and means for controlling drilling through a sixth interval utilizing the automatically selected one of the third WOB and the automatically selected one of the first WOB and the second WOB.

8. The apparatus of claim 7 further comprising:

means for controlling drilling through a seventh interval utilizing a first rotary drive revolutions-per-minute (RD-RPM);

means for automatically determining a fifth MSE corresponding to drilling utilizing the first RD-RPM;

means for controlling drilling through an eighth interval utilizing a second RD-RPM that is less than the first RD-RPM;

means for automatically determining a sixth MSE corresponding to drilling utilizing the second RD-RPM;

means for automatically comparing the fifth MSE and the sixth MSE and automatically selecting one of the first RD-RPM and the second RD-RPM as a function of the automated comparison of the fifth MSE and the sixth MSE;

means for controlling drilling through a ninth interval utilizing the automatically selected one of the first RD-RPM and the second RD-RPM;

means for controlling drilling through a tenth interval utilizing the automatically selected one of the first RD-RPM and the second RD-RPM;

means for automatically determining a seventh MSE corresponding to drilling through the tenth interval utilizing the automatically selected one of the first RD-RPM and the second RD-RPM;

means for controlling drilling through an eleventh interval utilizing a third RD-RPM that is greater than the first RD-RPM;

means for automatically determining an eighth MSE corresponding to drilling through the eleventh interval utilizing the third RD-RPM;

means for automatically comparing the seventh MSE and the eighth MSE and automatically selecting one of the third RD-RPM and the automatically selected one of the first RD-RPM and the second RD-RPM as a function of the automated comparison of the seventh MSE and the eighth MSE; and means for controlling drilling through a twelfth interval utilizing the automatically selected one of the third RD-RPM and the automatically selected one of the first RD-RPM and the second RD-RPM.

9. An apparatus, comprising:

a top drive configured to rotate a drill string within a wellbore;

a drawworks configured to vertically translate the top drive to alter the axial position of the drill string within the wellbore; and a controller configured to receive a plurality of mechanical specific energy (MSE) parameters, then automatically determine MSE, and then automatically generate and transmit control signals to the top drive and the drawworks to control actuation of the top drive and the drawworks, wherein the controller is configured to automatically generate the control signals based at least partially on the automatically determined MSE.

wherein the controller is configured to:

control actuation of the top drive and the drawworks during drilling through a first interval utilizing a first weight-on-bit (WOB);

automatically determine a first MSE corresponding to drilling through the first interval utilizing the first WOB;

control actuation of the top drive and the drawworks during drilling through a second interval utilizing a second WOB that is different than the first WOB;

automatically determine a second MSE corresponding to drilling through the second interval utilizing the second WOB; and control actuation of the top drive and the drawworks during drilling through a third interval utilizing one of the first WOB and the second WOB which is automatically selected based on an automated comparison of the first MSE and the second MSE.

10. The apparatus of claim 9 wherein the controller is further configured to:

control actuation of the top drive and the drawworks during drilling through a fourth interval utilizing a first top drive revolutions-per-minute (TD-RPM);

automatically determine a third MSE corresponding to drilling through the fourth interval utilizing the first TD-RPM;

control actuation of the top drive and the drawworks during drilling through a fifth interval utilizing a second TD-RPM that is different than the first TD-RPM;

automatically determine a fourth MSE corresponding to drilling through the fifth interval utilizing the second TD-RPM; and control actuation of the top drive and the drawworks during drilling through a sixth interval utilizing one of the first TD-RPM and the second TD-RPM which is automatically selected based on an automated comparison of the third MSE and the fourth MSE.

11. The apparatus of claim 9 wherein the second WOB is less than the first WOB, and wherein the controller is further configured to:

control actuation of the top drive and the drawworks during drilling through a fourth interval utilizing the automatically selected one of the first WOB and the second WOB;

automatically determine a third MSE corresponding to drilling through the fourth interval utilizing the automatically selected one of the first WOB and the second WOB;

control actuation of the top drive and the drawworks during drilling through a fifth interval utilizing a third WOB that is greater than the first WOB;

automatically determine a fourth MSE corresponding to drilling through the fifth interval utilizing the third WOB; and control actuation of the top drive and the drawworks during drilling through a sixth interval utilizing one of the third WOB and the automatically selected one of the first WOB and the second WOB which is automatically selected based on an automated comparison of the third MSE and the fourth MSE.

12. The apparatus of claim 11 wherein the controller is further configured to:

control actuation of the top drive and the drawworks during drilling through a seventh interval utilizing a first top drive revolutions-per-minute (TD-RPM);

automatically determine a fifth MSE corresponding to drilling through the seventh interval utilizing the first TD-RPM;

control actuation of the top drive and the drawworks during drilling through an eighth interval utilizing a second TD-RPM that is less than the first TD-RPM;

automatically determine a sixth MSE corresponding to drilling through the eighth interval utilizing the second TD-RPM;

control actuation of the top drive and the drawworks during drilling through a ninth interval utilizing one of the first TD-RPM and the second TD-RPM which is automatically selected based on an automated comparison of the fifth MSE and the sixth MSE;

control actuation of the top drive and the drawworks during drilling through a tenth interval utilizing the automatically selected one of the first TD-RPM and the second TD-RPM;

automatically determine a seventh MSE corresponding to drilling through the tenth interval utilizing the automatically selected one of the first TD-RPM and the second TD-RPM;

control actuation of the top drive and the drawworks during drilling through an eleventh interval utilizing a third TD-RPM that is greater than the first TD-RPM;

automatically determine an eighth MSE corresponding to drilling through the eleventh interval utilizing the third TD-RPM; and control actuation of the top drive and the drawworks during drilling through a twelfth interval utilizing one of the third TD-RPM and the automatically selected one of the first TD-RPM and the second TD-RPM which is automatically selected based on an automated comparison of the seventh MSE and the eighth MSE.

* * * * *